US010443944B2

(12) United States Patent
Inoue et al.

(10) Patent No.: US 10,443,944 B2
(45) Date of Patent: Oct. 15, 2019

(54) HEAT EXCHANGER AND AIR CONDITIONING DEVICE

(71) Applicant: DAIKIN INDUSTRIES, LTD., Osaka-shi, Osaka (JP)

(72) Inventors: Satoshi Inoue, Sakai (JP); Hirokazu Fujino, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/108,205

(22) PCT Filed: Dec. 22, 2014

(86) PCT No.: PCT/JP2014/083945
§ 371 (c)(1),
(2) Date: Jun. 24, 2016

(87) PCT Pub. No.: WO2015/098860
PCT Pub. Date: Jul. 2, 2015

(65) Prior Publication Data

US 2016/0320135 A1 Nov. 3, 2016

(30) Foreign Application Priority Data

Dec. 27, 2013 (JP) ..... 2013-273268

(51) Int. Cl.
*F28D 1/02* (2006.01)
*F28F 9/02* (2006.01)
(Continued)

(52) U.S. Cl.
CPC ..... *F28D 1/0233* (2013.01); *F25B 39/00* (2013.01); *F28D 1/0471* (2013.01);
(Continued)

(58) Field of Classification Search
CPC ..... F28F 9/0202–0217; F28F 9/028; F28F 9/026; F28F 9/0265; F28F 9/0268;
(Continued)

(56) References Cited

U.S. PATENT DOCUMENTS 4,922,732 A * 5/1990 Eriksson ..... F25B 39/028 165/174
6,606,882 B1 * 8/2003 Gupte ..... F25B 39/028 165/115
(Continued)

FOREIGN PATENT DOCUMENTS

JP 2-219966 A 9/1990
JP 10-281684 A 10/1998
(Continued)

OTHER PUBLICATIONS

International Search Report of corresponding PCT Application No. PCT/JP2014/083945 dated Apr. 7, 2015.
(Continued)

*Primary Examiner* — Christopher R Zerphey
*Assistant Examiner* — For K Ling
(74) *Attorney, Agent, or Firm* — Global IP Counselors, LLP

(57) ABSTRACT

A heat exchanger includes a plurality of flat tubes, a header collecting tube, and fins joined to the flat tubes. The header collecting tube includes a first partition member partitioning an internal space into upper and lower internal spaces, a second partition member partitioning the upper internal space into first and second spaces, an inflow port formed on the first partition member at a bottom part of the first space so as to penetrate in a plate thickness direction, an upper communicating passage, a lower communicating passage. The flat tubes are connected at one end to the first space of the header collecting tube. An inflow pipeline is connected to space that, within the lower internal space, is underneath the second space.

4 Claims, 16 Drawing Sheets

(51) Int. Cl.

| | |
|---|---|
| ***F25B 39/00*** | (2006.01) |
| ***F28D 1/047*** | (2006.01) |
| ***F28D 1/053*** | (2006.01) |
| ***F28F 9/22*** | (2006.01) |
| *F25B 13/00* | (2006.01) |

(52) U.S. Cl.
CPC ..... *F28D 1/05366* (2013.01); *F28F 9/0207* (2013.01); *F28F 9/028* (2013.01); *F28F 9/0265* (2013.01); *F28F 9/22* (2013.01); *F25B 13/00* (2013.01); *F28D 1/05391* (2013.01); *F28F 2215/12* (2013.01)

(58) Field of Classification Search
CPC .. F28F 9/02; F28F 9/22; F28D 1/0535; F28D 1/05375; F28D 1/05383; F28D 1/05391; F28D 1/0443; F25B 39/02; F25B 39/028
USPC ..... 165/173, 174
See application file for complete search history.

(56) References Cited

U.S. PATENT DOCUMENTS 6,688,137 B1 * 2/2004 Gupte ..... F25B 39/022 62/515
7,823,406 B2 * 11/2010 Higashiyama ..... B60H 1/00335 62/324.6
8,201,620 B2 * 6/2012 Aung ..... F25B 39/022 165/11.1
2005/0189090 A1 * 9/2005 Gupte ..... F25B 39/02 165/103
2005/0262872 A1 * 12/2005 Sacks ..... F25B 39/02 62/500
2006/0118287 A1 * 6/2006 Higgins ..... F28F 9/0212 165/174
2010/0314090 A1 * 12/2010 Moriya ..... F25B 39/028 165/174
2011/0030934 A1 * 2/2011 Munoz ..... F25B 39/00 165/157
2014/0338874 A1 11/2014 Jindou et al.

FOREIGN PATENT DOCUMENTS

| | | | | | |
|---|---|---|---|---|---|
| JP | 11-337293 | A | | 12/1999 | |
| JP | 11337293 | A | * | 12/1999 | |
| JP | WO 2009022575 | A1 | * | 2/2009 | ..... F25B 39/00 |
| JP | 2013-137193 | A | | 7/2013 | |
| JP | 5794293 | B2 | | 10/2015 | |
| WO | 2007094422 | A1 | | 8/2007 | |
| WO | 2009/022575 | A1 | | 2/2009 | |

OTHER PUBLICATIONS

European Search Report of corresponding EP Application No. 14 87 3283.7 dated Jan. 5, 2017.
International Preliminary Report of corresponding PCT Application No. PCT/JP2014/082004 dated Jul. 7, 2016.

* cited by examiner

HEAT EXCHANGER AND AIR CONDITIONING DEVICE

CROSS-REFERENCE TO RELATED APPLICATIONS

This U.S. National stage application claims priority under 35 U.S.C. § 119(a) to Japanese Patent Application No. 2013-273268, filed in Japan on Dec. 27, 2013, the entire contents of which are hereby incorporated herein by reference.

TECHNICAL FIELD

The present invention relates to a heat exchanger and an air conditioning device.

BACKGROUND ART

Heat exchangers having a plurality of flat tubes, fins which are joined to the plurality of flat tubes, and header collecting tubes which are coupled respectively to the plurality of flat tubes at a first end side and another end side thereof, for bringing about heat exchange between a refrigerant flowing through the interior the flat tubes and air flowing to the outside of the flat tubes, are known in the prior art.

For example, the heat exchanger disclosed in Japanese Laid-open Patent No. H02-219966 is configured such that a plurality of outflow tubes extending in a horizontal direction are connected at either end to header collecting tubes that respectively extend in a vertical direction.

The heat exchanger disclosed in Japanese Laid-open Patent No. H02-219966 is directed to the problem that, in the interior of the header collecting tubes that extend in the vertical direction, liquid phase refrigerant of high specific gravity collects towards the bottom while gas phase refrigerant of low specific gravity collects towards the top, thereby giving rise to eccentric flow; in order to solve this problem, the feature of forming a throttle inside the header collecting tubes is proposed.

Passing the refrigerant through the throttle formed in this manner facilitates mixing of the gas phase refrigerant and the liquid phase refrigerant, while at the same time improves the flow velocity, making it easy for the refrigerant to reach the top within the header collecting tubes, thereby suppressing eccentric flow of the refrigerant.

SUMMARY

Technical Problem

However, the heat exchanger presented in Japanese Laid-open Patent No. H02-219966 as described above was not at all expected to be used in situations in which the refrigerant circulation rate varies, and there were no examinations of structures that yield the effect of suppressing eccentric flow in any sort of case, whether the circulation rate be low or the circulation rate be high.

Specifically, in the case of a low circulation rate, a throttle is formed, thereby raising flow velocity and enabling eccentric flow to be suppressed by allowing refrigerant to reach the tops of the header collecting tube interiors, but in the case of a high circulation rate, the throttle causes the flow velocity to be too high and too much refrigerant of high specific gravity to collect at the tops, giving rise to eccentric flow.

On the other hand, even if suppressing eccentric flow is made possible by providing a degree-adjusted throttle so that flow velocity will not be too high in the case of a high circulation rate, it is difficult to allow refrigerant to reach the tops in the case of a low circulation rate, giving rise to eccentric flow.

As a countermeasure, the spaces on the sides of the header collecting tubes to which the flat tubes are connected and the spaces on the opposite sides thereof are partitioned by partition members, whereby it is therefore possible to make it easier for refrigerant to reach the top ends. Furthermore, if refrigerant that has passed the partition members can be returned to the original spaces via underneath the partition members, it is possible to avoid situations in which too much refrigerant of high specific gravity collects in the tops of the header collecting tubes, even when the refrigerant circulation rate is too high. Thus, eccentric flow of the refrigerant can be suppressed by causing the refrigerant to loop.

In this case, if the structure is such that refrigerant is directly supplied to the lower space in the header collecting tubes where a refrigerant ascending flow is created, the refrigerant can easily be guided upward from the lower space. However, in a structure in which refrigerant is not directly supplied to the lower space in the header collecting tubes where a refrigerant ascending flow is created, something new structure must be created in order to form an ascending flow of refrigerant.

With the foregoing in view, it is an object of the present invention to provide a heat exchanger and an air conditioning device, with which it is possible to form an ascending flow of refrigerant even in a structure in which refrigerant is not directly supplied to the lower space in the header collecting tubes where a refrigerant ascending flow is created.

Solution to Problem

The heat exchanger according to a first aspect of the present invention is provided with a plurality of flat tubes, a header collecting tube, and a plurality of fins. Each of the flat tubes has a plurality of refrigerant passage extending in the longitudinal direction. The plurality of flat tubes are arranged mutually side by side. The header collecting tube is disposed so as to extend in a vertical direction. The plurality of fins are joined to the flat tubes. The header collecting tube has a loop structure. The loop structure includes a first partition member and a second partition member, an inflow port, an upper communicating passage, and a lower communicating passage. The first partition member partitions internal space of the header collecting tube into upper internal space and lower internal space. The second partition member partitions the upper internal space into first space, which is space for making the refrigerant ascend, and second space, which is space for making the refrigerant descend, when the heat exchanger functions as an evaporator of refrigerant. The inflow port is formed on the first partition member at the bottom part of the first space so as to penetrate in the plate thickness direction. The upper communicating passage is located in upper part of the first space and the second space, and provide communication between the upper part of the first space and the second space, thereby guiding the refrigerant that has ascended within the first space into the second space. The lower communicating passage, which is located in lower part of the first space and the second space, provide communication between the lower part of the first space and the second space and guide the refrigerant from the second space to the first space, thereby returning the refrigerant from the second space to the first space, which has been guided from the first space to the second space and has descended within the second space. The flat multi-perforated tubes are connected at one end to either the first space or the second space of the header collecting tube. Inflow pipeline is connected to a space that, within the lower internal space, is underneath the second space.

With this heat exchanger, the internal space of the header collecting tube is partitioned by the partition member into the first space and the second space, whereby the area through which the refrigerant having flowed into the first space from the inflow port pass while ascending in the first space can be made smaller, as compared with the case in which the first space and the second space are not partitioned by partition member. For this reason, even when the circulation rate of the refrigerant is a low circulation rate, the refrigerant having flowed into the first space from the inflow port can be made to ascend in the narrow space of the first space only, whereby the refrigerant can easily reach the upper part of the internal space of the header collecting tube without experiencing any significant drop in the velocity of ascension of the refrigerant through the first space. For this reason, even when the circulation rate of the refrigerant is a low circulation rate, sufficient flow of the refrigerant to the flat tubes is possible.

Moreover, in this heat exchanger, the header collecting tube has a loop structure that includes the inflow port, the partition member, the upper communicating passage, and the lower communicating passage. For this reason, even when the flow velocity of the refrigerant inflowing to the first space from the inflow port is fast, such as may be encountered at high circulation rates, and the high-specific gravity refrigerant tends to collect in the upper part of the first space, it is possible for the high-specific gravity refrigerant having reached upper section of the first space to be returned back to the lower part of the first space by means of the loop structure. Specifically, with this loop structure, it is possible for the refrigerant having reached upper section of the first space to pass through the upper communicating passage and be fed to the second space side, and to then descend in the second space and flow through the lower communicating passage to be returned to the lower part of the first space. For this reason, even when the flow velocity of the refrigerant inflowing to the first space is fast, such as may be encountered at high circulation rates, and the high-specific gravity refrigerant pass tends to collect in the upper part of the first space, it is possible for a sufficient amount of refrigerant to flow to the flat tubes while the refrigerant is circulated.

A structure in which inflow port is formed in the first partition member below the first space of the upper internal space is adopted as the structure for creating an ascending flow of refrigerant in the first space in order to achieve a looping flow of refrigerant, which suppresses eccentric flow of the refrigerant as described above. In this heat exchanger, refrigerant is supplied to the lower internal space by passing through the inflow pipeline connected to the space in the lower internal space that is below the second space, and refrigerant is not directly supplied to the space underneath the first space on the side where the inflow port is disposed; therefore, the refrigerant supplied to the second space of the lower internal space cannot be made to pass directly through the inflow port of the first partition member. In this heat exchanger, the lower internal space is disposed so as to span below both the second space and the first space. For this reason, the refrigerant supplied to the space that within the lower internal space is below the second space, due to passing through the inflow pipeline, can be fed to the space that within the lower internal space is below the first space. The refrigerant fed to the space that within the lower internal space is below the first space is fed to the first space via the inflow port of the first partition member, whereby an ascending flow of refrigerant can be created in the first space.

For the above reasons, an ascending flow of refrigerant can be created in the first space due to the refrigerant passing through the lower internal space, even in a structure in which refrigerant is not directly supplied to the lower part of the space where a refrigerant ascending flow is created in the header collecting tube.

A heat exchanger according to a second aspect of the present invention is the heat exchanger according to the first aspect, wherein in the header collecting tube, the wall surface of the lower internal space on the side where the inflow pipeline is connected is disposed as extensions of the wall surface of the upper internal space on the side of the second space.

With this heat exchanger, the upper internal space and the lower internal space within the internal space of the header collecting tube is disposed so that the wall surface on the second-space side of the upper internal space and the wall surface on the side where the inflow pipeline is connected is continuously linked to each other. For this reason, the lower internal space can be formed in a simple manner merely by using the first partition member to partition the internal space of the header collecting tube into one side and another side in the longitudinal direction.

A heat exchanger according to a third aspect of the present invention is the heat exchanger according to the first or second aspect, wherein the flat tubes are connected at one end to the first space of the header collecting tube.

With this heat exchanger, the interiors of the first space, through which refrigerant ascends, is vertically long and thin due to the interior of the header collecting tube being partitioned by the second partition member. For this reason, a sufficient amount of refrigerant can flow also to the flat tubes connected to the upper part of the first space, even when the rate of ascension of refrigerant in the first spaces is low. When the rate of ascension of refrigerant in the first space is high, the refrigerant passes forcefully while traversing the flat tubes located at the lower part of the first space and easily reaches the upper part of the first space; therefore, a sufficient amount of refrigerant can flow to the flat tubes connected to the upper part of the first space, and because refrigerant is returned to the first space after having reached the upper part and descended in the second space, a sufficient amount of refrigerant can be supplied also to the flat tubes connected to the lower part of the first space. Eccentric flow of the refrigerant can thereby be suppressed more reliably.

An air conditioning device according to a fourth aspect of the present invention is provided with a refrigerant circuit. The refrigerant circuit is constituted by connecting the heat exchanger according to any one of the first to third aspects of the present invention, and a variable-capacity compressor.

With this air conditioning device, driving by the variable-capacity compressor causes the rate at which the refrigerant flowing circulates through the refrigerant circuit to fluctuate, and the amount of refrigerant passing through the heat exchanger to fluctuate. In cases in which the heat exchanger functions as an evaporator, it will be possible to keep eccentric flow of the refrigerant within the heat exchanger to a minimum, even when the amount of the refrigerant passing therethrough increases and the mixture ratio of liquid phase refrigerant increases, or the flow velocity increases.

Advantageous Effects of Invention

With the heat exchanger according to the first aspect, an ascending flow of refrigerant can be created in the first space due to the refrigerant passing through the lower internal space, even in a structure in which refrigerant is not directly supplied to the lower part of the space where a refrigerant ascending flow is created in the header collecting tube.

With the heat exchanger according to the second aspect, the lower internal space can be formed in a simple manner merely by using the first partition member to partition the internal space of the header collecting tube into one side and another side in the longitudinal direction With the heat exchanger according to the third aspect, eccentric flow of the refrigerant can be suppressed more reliably.

With the air conditioning device according to the fourth aspect of the present invention, in cases in which the heat exchanger functions as an evaporator, it is possible to keep eccentric flow of the refrigerant within the heat exchanger to a minimum, even when the amount of the refrigerant passing therethrough increases and the mixture ratio of liquid phase refrigerant increases, or the flow velocity increases.

DESCRIPTION OF EMBODIMENTS

(1) Overall Configuration of Air Conditioning Device 1

Figure 1:
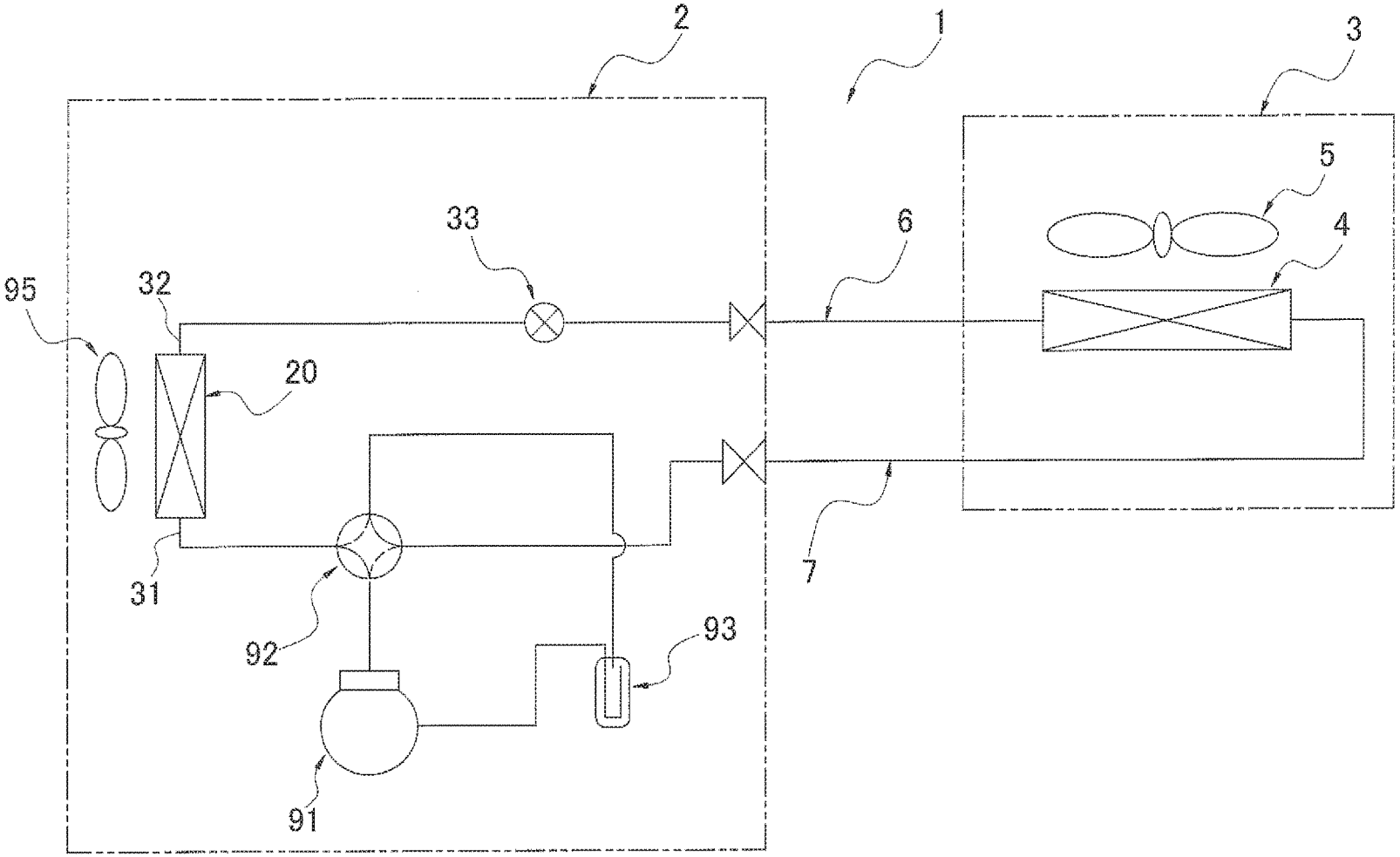
FIG. 1 is a circuit diagram of overview of the scheme of an air conditioning device according to a first embodiment.

FIG. 1 is a circuit diagram describing in overview a configuration of an air conditioning device 1 according to a first embodiment of the present invention.

This air conditioning device 1 is a device used for cooling and heating, through vapor compression refrigerating cycle operation, of a building interior in which an air conditioning indoor unit 3 has been installed, and is constituted by an air conditioning outdoor unit 2 as a heat source-side unit and the air conditioning indoor unit 3 as a user-side unit, which are connected by refrigerant interconnecting pipelines 6, 7.

The refrigerant circuit constituted by connection of the air conditioning outdoor unit 2, the air conditioning indoor unit 3, and the refrigerant interconnecting pipelines 6, 7 is further constituted by connecting a compressor 91, a four-way switching valve 92, an outdoor heat exchanger 20, an expansion valve 33, an indoor heat exchanger 4, an accumulator 93, and the like, through refrigerant pipelines. A refrigerant is sealed within this refrigerant circuit, and refrigerating cycle operation involving compression, cooling, depressurization, and heating/evaporation of the refrigerant, followed by re-compression, is carried out. As the refrigerant, there may be employed one selected, for example, from R410A, R32, R407C, R22, R134a, carbon dioxide, and the like.

(2) Detailed Configuration of Air Conditioning Device 1

(2-1) Air Conditioning Indoor Unit 3

The air conditioning indoor unit 3 is installed by being wall-mounted on an indoor wall or the like, or by being recessed within or suspended from an indoor ceiling of a building or the like. The air conditioning indoor unit 3 includes the indoor heat exchanger 4 and an indoor fan 5. The indoor heat exchanger 4 is, for example, a fin-and-tube heat exchanger of cross fin type, constituted by a heat transfer tube and a multitude of fins. In cooling mode, the heat exchanger functions as an evaporator for the refrigerant to cool the indoor air, and in heating mode functions as a condenser for the refrigerant to heat the indoor air.

(2-2) Air Conditioning Outdoor Unit 2

Figure 2:
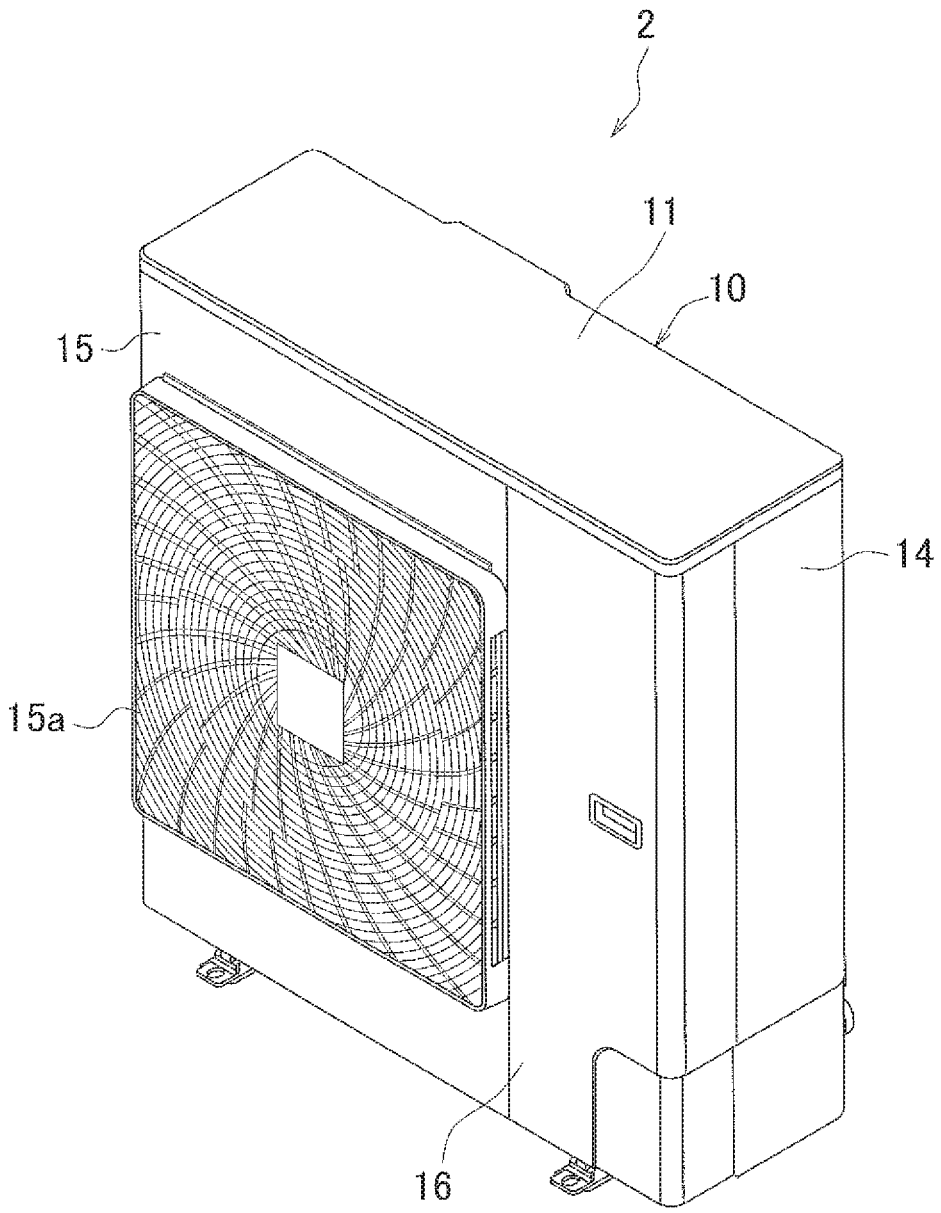
FIG. 2 is a perspective view of the exterior of an air conditioning outdoor unit.
Figure 3:
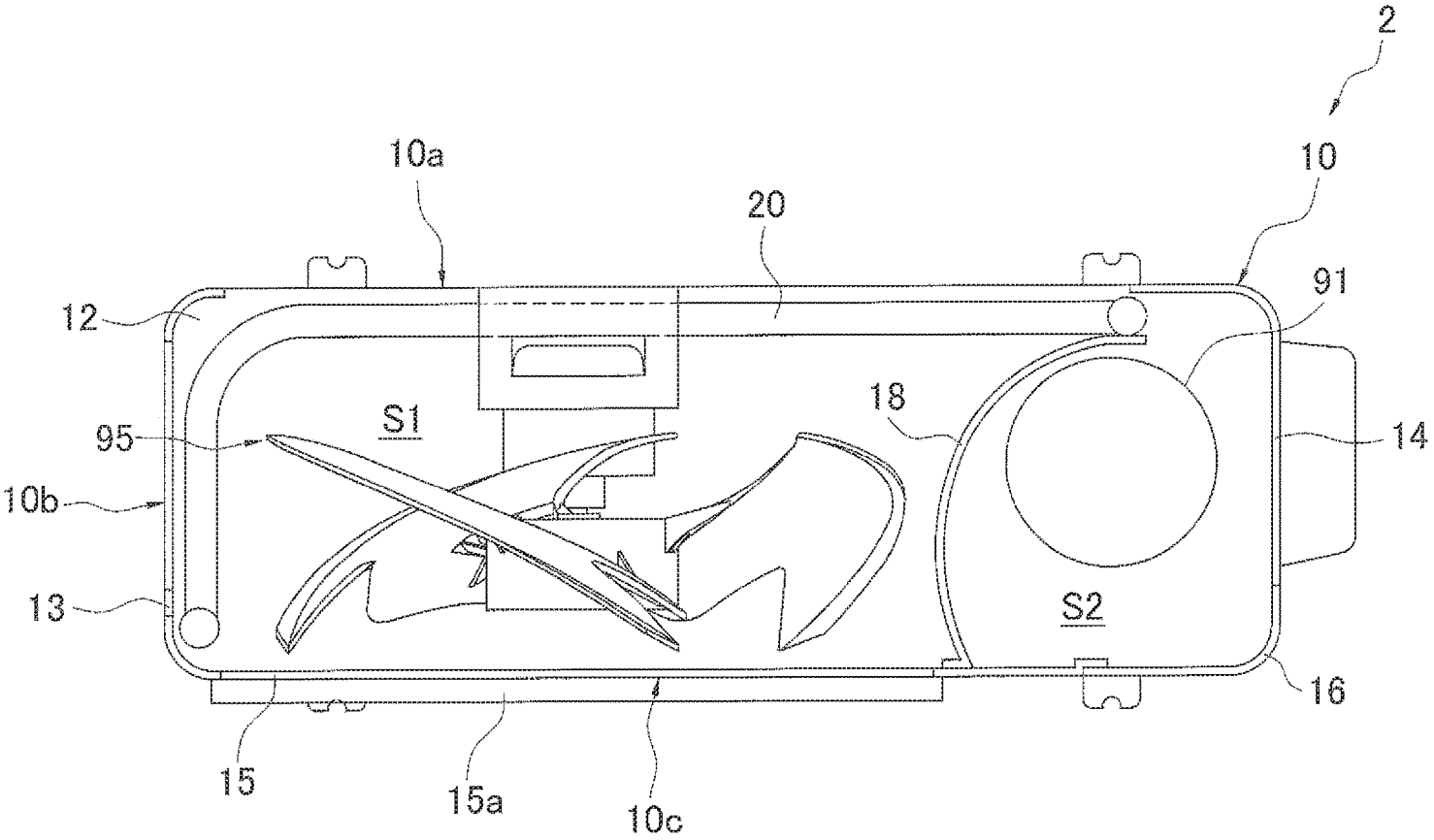
FIG. 3 is a schematic cross sectional view of an overview of placement of machinery of an air conditioning outdoor unit.

The air conditioning outdoor unit 2 is installed outside a building or the like, and is connected to the air conditioning indoor unit 3 by the refrigerant interconnecting pipelines 6, 7. As shown in FIG. 2 and FIG. 3, the air conditioning outdoor unit 2 has a unit casing 10 of substantially cuboid shape.

As shown in FIG. 3, the air conditioning outdoor unit 2 has a structure (a so-called "trunk" type structure) in which a blower chamber S1 and a machinery chamber S2 are formed by dividing an internal space of the unit casing 10 into two by a partition panel 18 that extends in a vertical direction. The air conditioning outdoor unit 2 includes an outdoor heat exchanger 20 and an outdoor fan 95 which are arranged within the blower chamber S1 of the unit casing 10, and also includes the compressor 91, the four-way switching valve 92, the accumulator 93, the expansion valve 33, a gas refrigerant pipeline 31, and a liquid refrigerant pipeline 32 which are arranged within the machinery chamber S2 of the unit casing 10.

The unit casing 10 constitutes a chassis and is provided with a bottom panel 12, a top panel 11, a side panel 13 at the blower chamber side, a side panel 14 at the machinery chamber side, a blower chamber-side front panel 15, and a machinery chamber-side front panel 16.

The air conditioning outdoor unit 2 is configured in such a way that outdoor air is sucked into the blower chamber S1 within the unit casing 10 from parts of the rear surface and the side surface of the unit casing 10, and the sucked in outdoor air is vented from the front surface of the unit casing 10. In specific terms, an intake port 10*a* and an intake port 10*b* facing the blower chamber S1 within the unit casing 10 are formed between the rear face-side end of the side panel 13 on the blower chamber side and the blower chamber S1-side end of the side panel 14 at the machinery chamber side. The blower chamber-side front panel 15 is furnished with a vent 10*c*, the front side thereof being covered by a fan grill 15*a*.

The compressor 91 is, for example, a sealed compressor driven by a compressor motor, and is configured such that the operating capacity can be varied through inverter control.

The four-way switching valve 92 is a mechanism for switching the direction of flow of the refrigerant. In cooling mode, the four-way switching valve 92 connects a refrigerant pipeline from the discharge side of the compressor 91 and the gas refrigerant pipeline 31 which extends from a first end (the gas-side end) of the outdoor heat exchanger 20, as well as connecting, via the accumulator 93, the refrigerant interconnecting pipeline 7 for the gas refrigerant and the refrigerant pipeline at the intake side of the compressor 91 (see the solid lines of the four-way switching valve 92 in FIG. 1). In heating mode, the four-way switching valve 92 connects the refrigerant pipeline from the discharge side of the compressor 91 and the refrigerant interconnecting pipeline 7 for the gas refrigerant, as well as connecting, via the accumulator 93, the intake side of the compressor 91 and the gas refrigerant pipeline 31 which extends from the first end (the gas-side end) of the outdoor heat exchanger 20 (see the broken lines of the four-way switching valve 92 in FIG. 1).

The outdoor heat exchanger 20 is arranged upright in a vertical direction (plumb vertical direction) in the blower chamber S1, and faces the intake ports 10*a*, 10*b*. The outdoor heat exchanger 20 is a heat exchanger made of aluminum; in the present embodiment, one having design pressure of about 3-4 MPa is employed. The gas refrigerant pipeline 31 extends from the first end (the gas-side end) of the outdoor heat exchanger 20, so as to connect to the four-way switching valve 92. The liquid refrigerant pipeline 32 extends from the other end (the liquid-side end) of the outdoor heat exchanger 20, so as to connect to the expansion valve 33.

The accumulator 93 is connected between the four-way switching valve 92 and the compressor 91. The accumulator 93 is equipped with a gas-liquid separation function for separating the refrigerant into a gas phase and a liquid phase. Refrigerant inflowing to the accumulator 93 is separated into the gas phase and the liquid phase, and the gas phase refrigerant which collects in the upper spaces is supplied to the compressor 91.

The outdoor fan 95 supplies the outdoor heat exchanger 20 with outdoor air for heat exchange with the refrigerant flowing through the outdoor heat exchanger 20.

The expansion valve 33 is a mechanism for depressurizing the refrigerant in the refrigerant circuit, and is an electrically operated valve, the valve opening of which is adjustable. In order to make adjustments to the refrigerant pressure and the refrigerant flow rate, the expansion valve 33 is disposed between the outdoor heat exchanger 20 and the refrigerant interconnecting pipeline 6 for the liquid refrigerant, and has the function of expanding the refrigerant, both in cooling mode and heating mode.

The outdoor fan 95 is arranged facing the outdoor heat exchanger 20 in the blower chamber S1. The outdoor fan 95 sucks outdoor air into the unit, and after heat exchange between the outdoor air and the refrigerant has taken place in the outdoor heat exchanger 20, discharges the heat-exchanged air to the outdoors. This outdoor fan 95 is a fan in which it is possible to adjust the air volume of the air supplied to the outdoor heat exchanger 20, and could be, for example, a propeller fan driven by a motor, such as a DC fan motor, or the like.

(3) Operation of Air Conditioning Device 1

(3-1) Cooling Mode

In cooling mode, the four-way switching valve 92 enters the state shown by the solid lines in FIG. 1, i.e., a state in which the discharge side of the compressor 91 is connected to the gas side of the outdoor heat exchanger 20 via the gas refrigerant pipeline 31, and the intake side of the compressor 91 is connected to the gas side of the indoor heat exchanger 4 via the accumulator 93 and the refrigerant interconnecting pipeline 7. The design of the expansion valve 33 is such that valve opening adjustments are made to maintain a constant degree of superheat (degree of superheat control) of the refrigerant at the outlet of the indoor heat exchanger 4 (i.e., the gas side of the indoor heat exchanger 4). With the refrigerant circuit in this state, when the compressor 91, the outdoor fan 95, and the indoor fan 5 are run, low-pressure gas refrigerant is compressed by the compressor 91 to become high-pressure gas refrigerant. This high-pressure gas refrigerant is fed to the outdoor heat exchanger 20 through the four-way switching valve 92. Subsequently, the high-pressure gas refrigerant undergoes heat exchange in the outdoor heat exchanger 20 with outdoor air supplied by the outdoor fan 95, and is condensed to become high-pressure liquid refrigerant. The high-pressure liquid refrigerant, now in a supercooled state, is fed to the expansion valve 33 from the outdoor heat exchanger 20. Refrigerant having been depressurized to close to the intake pressure of the compressor 91 by the expansion valve 33 and entered a low-pressure, gas-liquid two-phase state is fed to the indoor heat exchanger 4, and undergoes heat exchange with indoor air in the indoor heat exchanger 4, evaporating to become low-pressure gas refrigerant.

This low-pressure gas refrigerant is fed to the air conditioning outdoor unit 2 through the refrigerant interconnecting pipeline 7, and is again sucked into the compressor 91. In this cooling mode, the air conditioning device 1 prompts the outdoor heat exchanger 20 to function as a condenser for the refrigerant compressed in the compressor 91, and the indoor heat exchanger 4 to function as an evaporator for the refrigerant condensed in the outdoor heat exchanger 20.

In the refrigerant circuit during cooling mode, while degree of superheat control by the expansion valve 33 is taking place, the compressor 91 is inverter-controlled to a set temperature (such that the cooling load can be processed), and therefore the circulation rate of the refrigerant may be a high circulation rate in some cases, and a low circulation rate in others.

(3-2) Heating Operation

In heating mode, the four-way switching valve 92 enters the state shown by broken lines in FIG. 1, i.e., a state in which the discharge side of the compressor 91 is connected to the gas side of the indoor heat exchanger 4 via the refrigerant interconnecting pipeline 7, and the intake side of the compressor 91 is connected to the gas side of the outdoor heat exchanger 20 via the gas refrigerant pipeline 31. The design of the expansion valve 33 is such that valve-opening adjustments are made to maintain the degree of supercooling of the refrigerant at the outlet of the indoor heat exchanger 4 at a target degree of supercooling value (degree of supercooling control). With the refrigerant circuit in this state, when the compressor 91, the outdoor fan 95, and the indoor fan 5 are run, low-pressure gas refrigerant is compressed by the compressor 91 to become high-pressure gas refrigerant, and is fed to the air conditioning indoor unit 3 through the four-way switching valve 92 and the refrigerant interconnecting pipeline 7.

The high-pressure gas refrigerant fed to the air conditioning indoor unit 3 then undergoes heat exchange with indoor air in the indoor heat exchanger 4, and is condensed to become high-pressure liquid refrigerant, then while passing through the expansion valve 33 is depressurized to an extent commensurate with the valve opening of the expansion valve 33. The refrigerant having passed through the expansion valve 33 flows into the outdoor heat exchanger 20. The refrigerant in a low-pressure, gas-liquid two-phase state having flowed into the outdoor heat exchanger 20 undergoes heat exchange with outdoor air supplied by the outdoor fan 95, evaporates to become low-pressure gas refrigerant, and is again sucked into the compressor 91 through the four-way switching valve 92. In this heating mode, the air conditioning device 1 prompts the indoor heat exchanger 4 to function as a condenser for the refrigerant compressed in the compressor 91, and the outdoor heat exchanger 20 to function as an evaporator for the refrigerant condensed in the indoor heat exchanger 4.

In the refrigerant circuit during heating mode, while degree of supercooling control by the expansion valve 33 is taking place, the compressor 91 is inverter-controlled to a set temperature (such that the heating load can be processed), and therefore the circulation rate of the refrigerant may be a high circulation rate in some cases, and a low circulation rate in others.

(4) Detailed Configuration of the Outdoor Heat Exchanger 20

(4-1) Overall Configuration of the Outdoor Heat Exchanger 20

Figure 4:
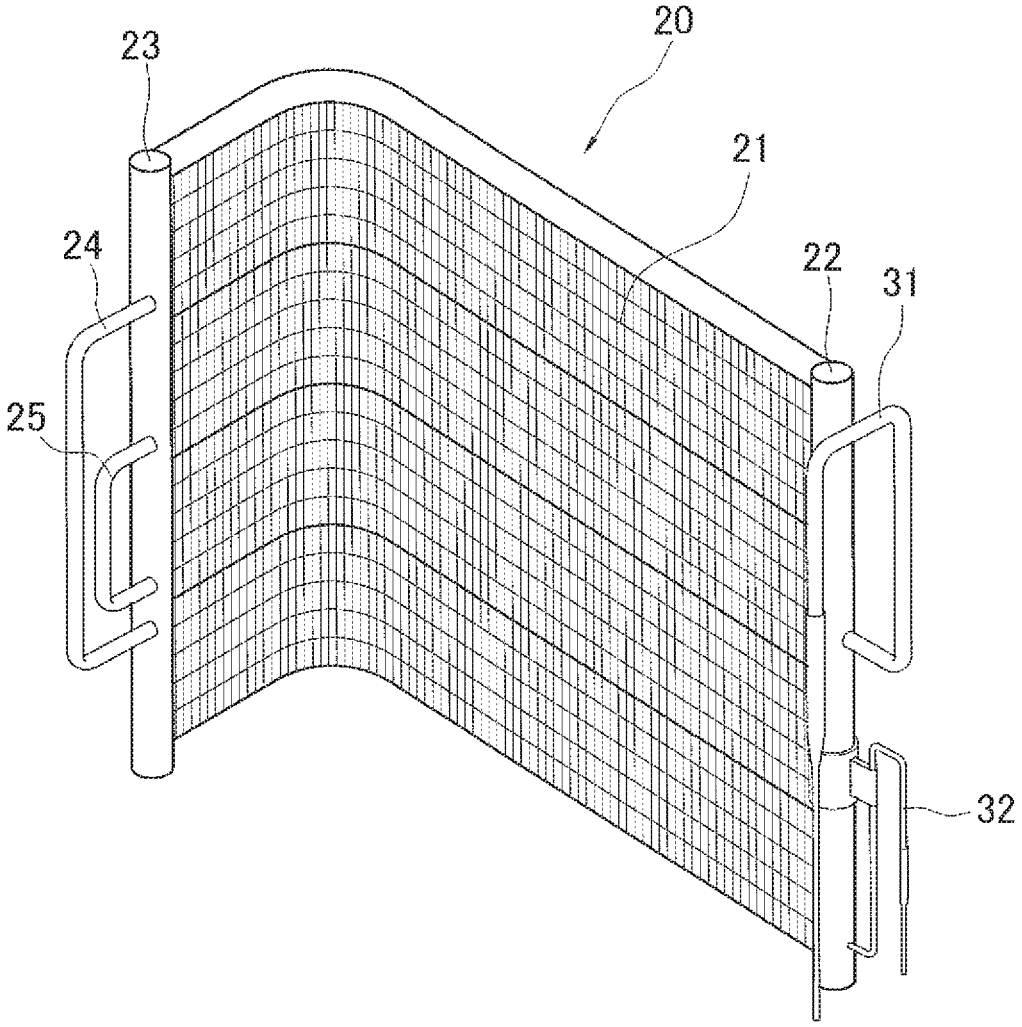
FIG. 4 is an exterior simplified perspective view of an outdoor heat exchanger, a gas refrigerant pipeline, and a liquid refrigerant pipeline.
Figure 5:
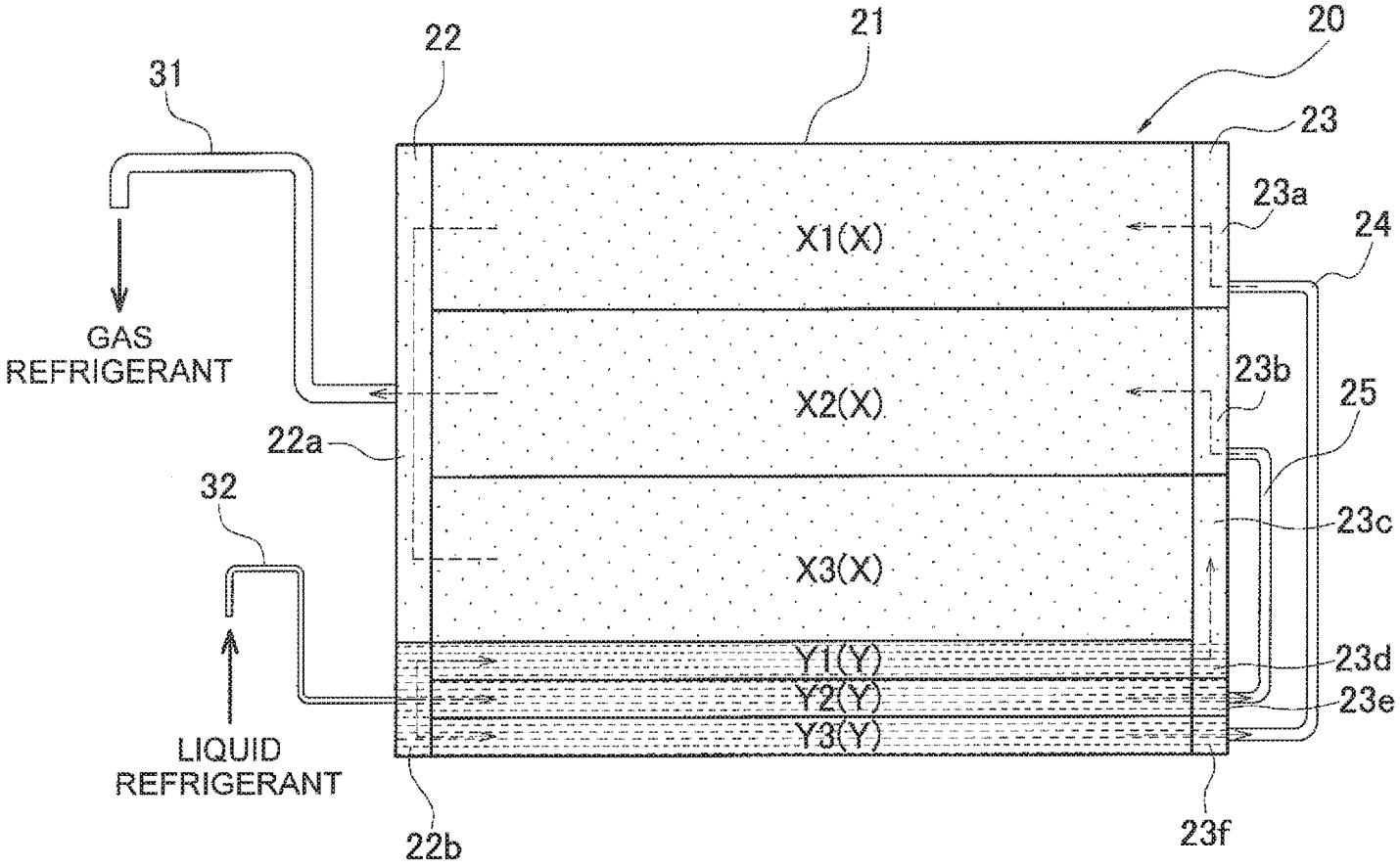
FIG. 5 is a schematic rear view of a simplified configuration of an outdoor heat exchanger.
Figure 6:
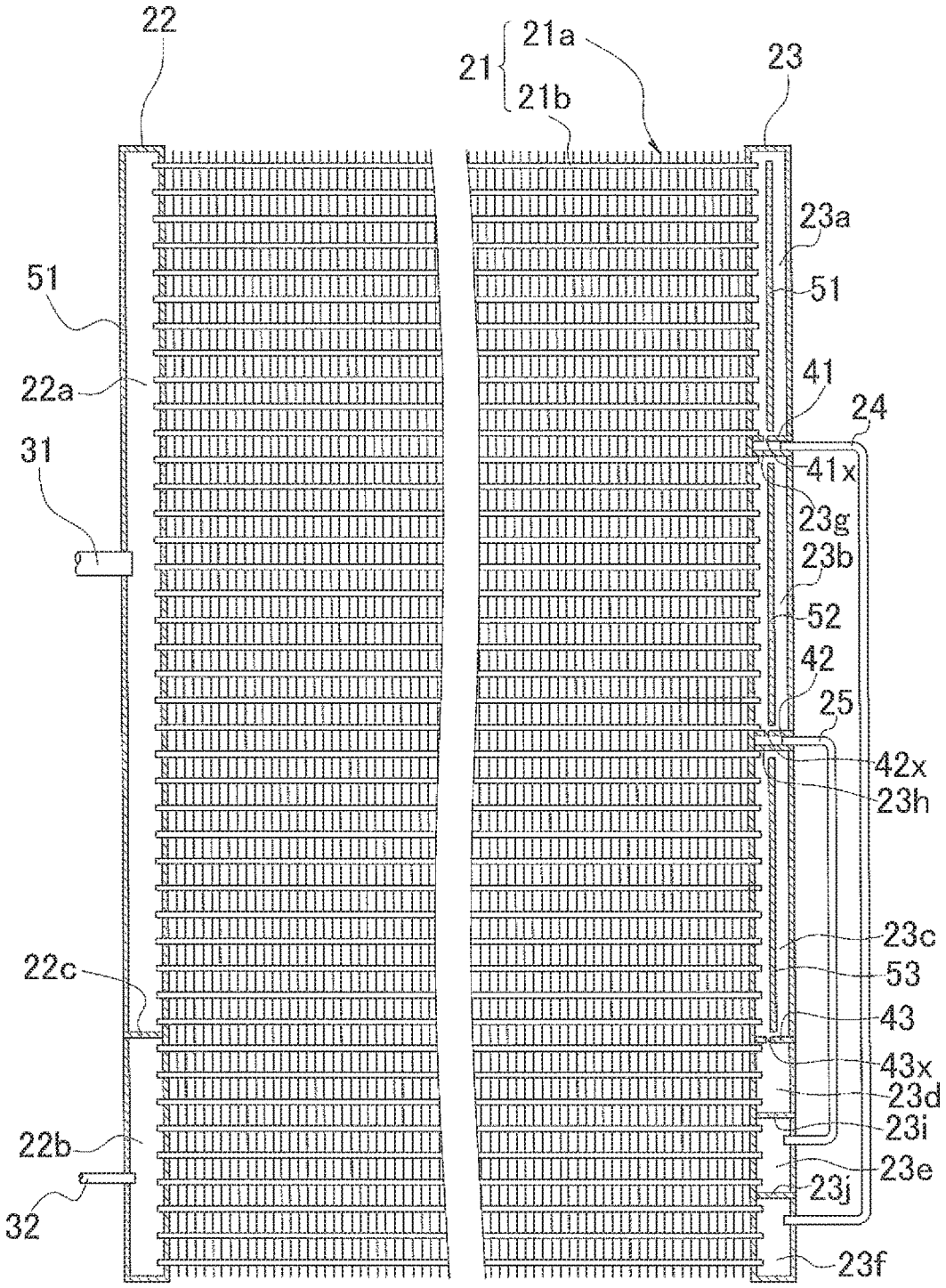
FIG. 6 is a simplified rear view of a configuration of an outdoor heat exchanger.

Next, the configuration of the outdoor heat exchanger 20 is described in detail, using FIG. 4, which shows an exterior simplified perspective view of the outdoor heat exchanger 20, FIG. 5, which shows a schematic rear view of the outdoor heat exchanger, and FIG. 6, which is a simplified rear view.

The outdoor heat exchanger 20 is provided with a heat exchange part 21 where heat exchange takes place between outdoor air and the refrigerant, an outlet/inlet header collecting tube 22 disposed at a first end of this heat exchange part 21, and a doubled-back header collecting tube 23 disposed at the other end of this heat exchange part 21.

(4-2) Heat Exchange Part 21

Figure 7:
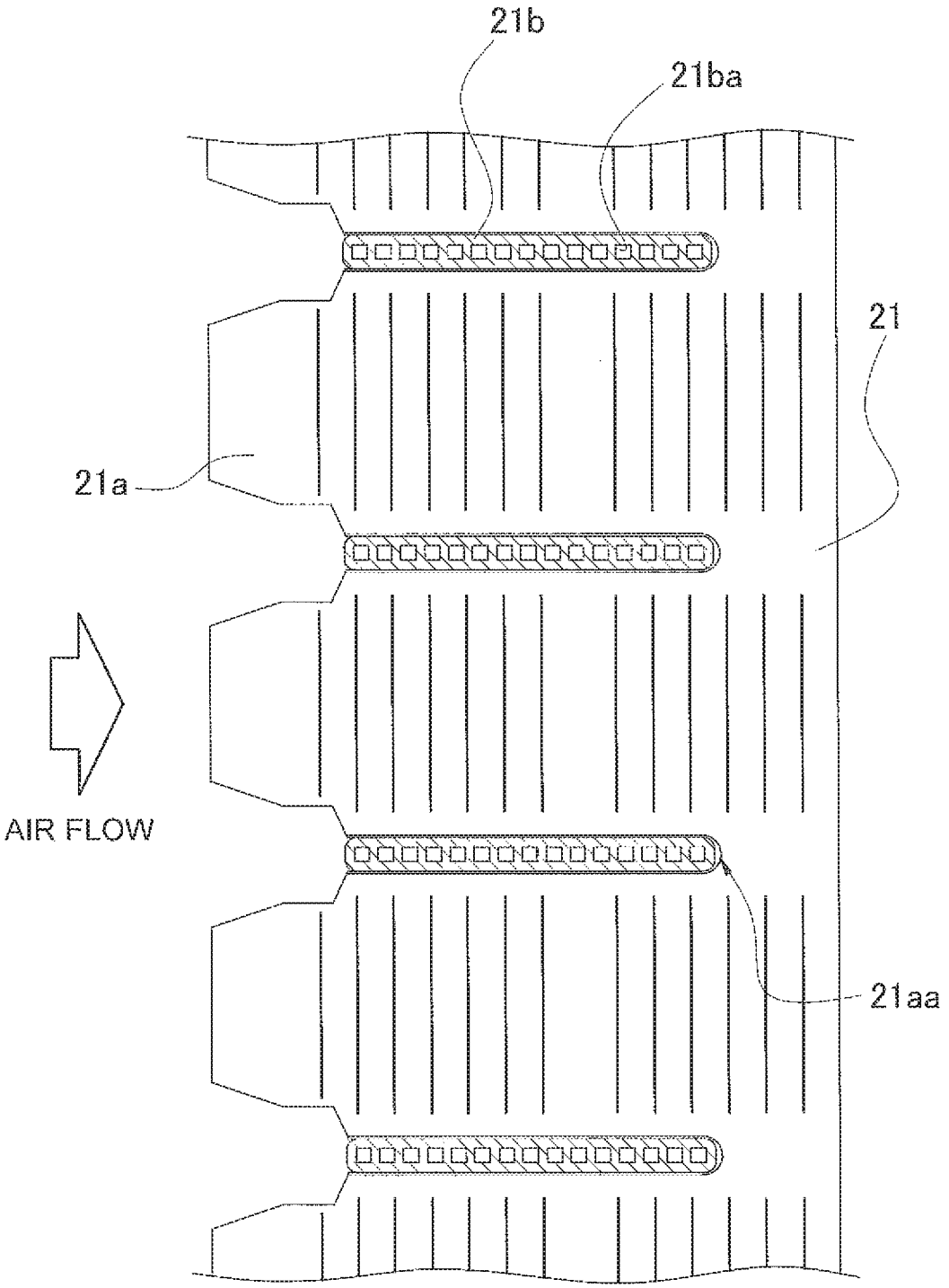
FIG. 7 is a fragmentary enlarged cross sectional view of a configuration of a heat exchange part of an outdoor heat exchanger.
Figure 8:
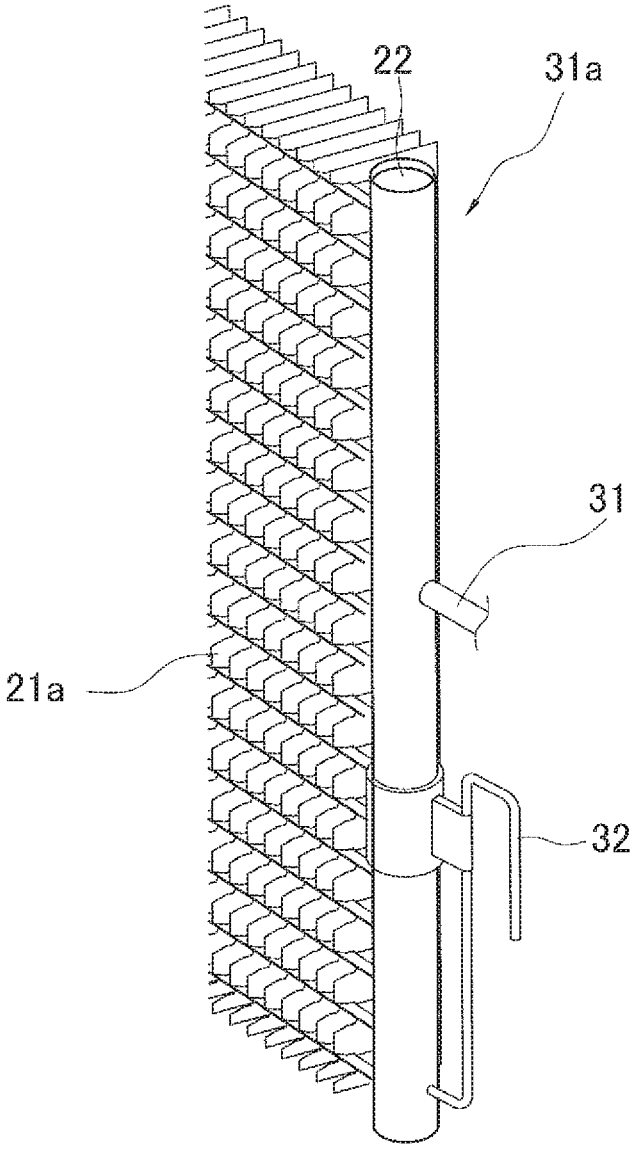
FIG. 8 is a simplified perspective view of heat transfer fins attached to an outdoor heat exchanger.

FIG. 7 is a fragmentary enlarged cross sectional view of a cross sectional structure of the heat exchange part 21 of the outdoor heat exchanger 20, in a plane perpendicular to the direction of flattening of flat multi-perforated tubes 21*b* thereof. FIG. 8 is a simplified perspective view of heat transfer fins 21*a* attached in the outdoor heat exchanger 20.

The heat exchange part 21 has an upper-side heat exchange area X positioned on the upper side, and a lower-side heat exchange area Y positioned below the upper-side heat exchange area X. Of these areas, the upper-side heat exchange area X has a first upper-side heat exchange part X1, a second upper-side heat exchange part X2, and a third upper-side heat exchange part X3, arranged side by side in that order from the top. The lower-side heat exchange area Y has a first lower-side heat exchange part Y1, and second lower-side heat exchange part Y2, and a third lower-side heat exchange part Y3, arranged side by side in that order from the top.

This heat exchange part 21 is constituted by a multitude of the heat transfer fins 21*a* and a multitude of the flat multi-perforated tubes 21*b*. The heat transfer fins 21*a* and the flat multi-perforated tubes 21*b* are both fabricated from aluminum or aluminum alloy.

The heat transfer fins 21*a* are flat members, and a plurality of cutouts 21*aa* extending in a horizontal direction for insertion of flattened tubes are formed side by side in a vertical direction in the heat transfer fins 21*a*. The heat transfer fins 21*a* are attached so as to have innumerable sections protruding towards the upstream side of the airflow.

The flat multi-perforated tubes 21*b* function as heat transfer tubes for transferring heat moving between the heat transfer fins 21*a* and the outside air to the refrigerant flowing through the interior. The flat multi-perforated tubes 21*b* have upper and lower flat surfaces serving as heat transfer surfaces, and a plurality of internal channels 21*ba* through which the refrigerant flows. The flat multi-perforated tubes 21*b*, which are slightly thicker in vertical breadth than the cutouts 21*aa*, are arrayed spaced apart in a plurality of tiers with the heat transfer surfaces facing up and down, and are temporarily fastened by being fitted into the cutouts 21*aa*. With the flat multi-perforated tubes 21*b* temporarily fastened by being fitted into the cutouts 21*aa* of the heat transfer fins 21*a* in this manner, the heat transfer fins 21*a* and the flat multi-perforated tubes 21*b* are brazed. The flat multi-perforated tubes 21*b* are fitted at either end into the outlet/inlet header collecting tube 22 and the doubled-back header collecting tube 23, respectively, and brazed. In so doing, an upper outlet/inlet internal space 22*a* and a lower outlet/inlet internal space 22*b* in the outlet/inlet header collecting tube 22, discussed below, and/or first to sixth internal spaces 23*a*, 23*b*, 23*c*, 23*d*, 23*e*, 23*f* of the doubled-back header collecting tube 23, and internal flow channels 21*ba* of the flat multi-perforated tubes 21*b*, discussed below, are linked.

As shown in FIG. 7, the heat transfer fins 21*a* link up on the vertical, and therefore any dew condensation occurring on the heat transfer fins 21*a* and/or the flat multi-perforated tubes 21*b* will drip down along the heat transfer fins 21*a* and drain to the outside through a path formed in the bottom panel 12.

(4-3) Outlet/Inlet Header Collecting Tube 22

The outlet/inlet header collecting tube 22 is a cylindrical member made of aluminum or aluminum alloy, disposed at a first end of the heat exchange part 21, and extending in the vertical direction.

The outlet/inlet header collecting tube 22 includes the upper outlet/inlet internal spaces 22*a*, 22*b* which are partitioned off in the vertical direction by a first baffle 22*c*. The gas refrigerant pipeline 31 is connected to the upper outlet/inlet internal space 22*a* in a top part, and the liquid refrigerant pipeline 32 is connected to the lower outlet/inlet internal space 22*b* in a bottom part.

Both the upper outlet/inlet internal space 22*a* in the top part of the outlet/inlet header collecting tube 22 and the lower outlet/inlet internal space 22*b* in the bottom part are connected to first ends of the plurality of flat multi-perforated tubes 21*b*. More specifically, the first upper-side heat exchange part X1, the second upper-side heat exchange part X2, and the third upper-side heat exchange part X3 of the upper-side heat exchange area X are disposed in such a way as to correspond to the upper outlet/inlet internal space 22*a* in the top part of the outlet/inlet header collecting tube 22. The first lower-side heat exchange part Y1, the second lower-side heat exchange part Y2, and the third lower-side heat exchange part Y3 of the lower-side heat exchange area Y are disposed in such a way as to correspond to the lower outlet/inlet internal space 22*b* in the bottom part of the outlet/inlet header collecting tube 22.

(4-4) Doubled-Back Header Collecting Tube 23

The doubled-back header collecting tube 23 is a cylindrical member made of aluminum or aluminum alloy, disposed at the other end of the heat exchange part 21, and extending in the vertical direction.

The interior of the doubled-back header collecting tube 23 is partitioned in the vertical direction by a second baffle 23*g*, a third baffle 23*h*, a third flow regulation plate 43, a fourth baffle 23*i*, and a fifth baffle 23*j*, forming the first to sixth internal spaces 23*a*, 23*b*, 23*c*, 23*d*, 23*e*, 23*f*.

Of these, the three first to third internal spaces 23*a*, 23*b*, 23*c* of the doubled-back header collecting tube 23 are connected to the other ends of a multitude of the flat multi-perforated tubes 21*b*, which are connected at their first ends to the upper outlet/inlet internal space 22*a* at the upper part of the outlet/inlet header collecting tube 22. Specifically, the first upper-side heat exchange part X1 of the upper-side heat exchange area X is disposed in such a way as to correspond to the first internal space 23*a* of the doubled-back header collecting tube 23, the second upper-side heat exchange part X2 of the upper-side heat exchange area X in such a way as to correspond to the second internal space 23*b* of the doubled-back header collecting tube 23, and the third upper-side heat exchange part X3 of the upper-side heat exchange area X in such a way as to correspond to the third internal space 23*c* of the doubled-back header collecting tube 23, respectively.

The multitude of flat multi-perforated tubes 21*b* connected at their first ends to the lower outlet/inlet internal space 22*b* in the bottom part of the outlet/inlet header collecting tube 22 connect at their other ends to the three fourth internal spaces 23*d*, 23*e*, 23*f* of the doubled-back header collecting tube 23. Specifically, the first lower-side heat exchange part Y1 of the lower-side heat exchange area Y is disposed in such a way as to correspond to the fourth internal space 23*d* of the doubled-back header collecting tube 23, the second lower-side heat exchange part Y2 of the lower-side heat exchange area Y in such a way as to correspond to the fifth internal space 23*e* of the doubled-back header collecting tube 23, and the third lower-side heat exchange part Y3 of the lower-side heat exchange area Y in such a way as to correspond to the sixth internal space 23*f* of the doubled-back header collecting tube 23, respectively.

The first internal space 23*a* of the topmost tier and the internal space 23*f* of the bottommost tier of the doubled-back header collecting tube 23 are connected by an interconnecting pipeline 24.

The second internal space 23*b* of the second tier from the top and the fifth internal space 23*e* of the second tier from the bottom are connected by an interconnecting pipeline 25.

The third internal space 23*c* of the third tier from the top and the fourth internal space 23*d* of the third tier from the bottom are partitioned apart by the third flow regulation plate 43, but have sections that communicate vertically via a third inflow port 43*x* disposed in the flow regulation plate 43.

The design is such that the number of flat multi-perforated tubes 21*b* into which refrigerant flowing in from the interconnecting pipeline 24 branches in the first internal space 23*a* of the doubled-back header collecting tube 23 is greater than the number of flat multi-perforated tubes 21*b* into which the refrigerant flowing from the liquid refrigerant pipeline 32 branches in the lower outlet/inlet internal space 22*b* of the outlet/inlet header collecting tube 22 as the refrigerant advances to the sixth internal space 23*f* (the same holds for the relationship of the numbers of the flat multi-perforated tubes 21*b* of the second internal space 23*b* and the fifth internal space 23*e*, and/or the relationship of the numbers of the flat multi-perforated tubes 21*b* of the third internal space 23*c* and the fourth internal space 23*d*).

While different arrangements may be employed in order to optimize distribution of the refrigerant, in the present embodiment, the number of the flat multi-perforated tubes 21*b* connected to the first internal space 23*a*, the number of the flat multi-perforated tubes 21*b* connected to the second internal space 23*b*, and the number of the flat multi-perforated tubes 21*b* connected to the third internal space 23*c* are substantially equal. Likewise, while different arrangements may be employed in order to optimize distribution of the refrigerant, in the present embodiment, the number of the flat multi-perforated tubes 21*b* connected to the fourth internal space 23*d*, the number of the flat multi-perforated tubes 21*b* connected to the fifth internal space 23*e*, and the number of the flat multi-perforated tubes 21*b* connected to the sixth internal space 23*f* are substantially equal.

(4-5) Loop Structure of Doubled-Back Header Collecting Tube 23

In the doubled-back header collecting tube 23, the upper three first to third internal spaces 23*a*, 23*b*, 23*c* are furnished with a loop structure and with a flow regulating structure.

The loop structure and a flow regulating structure of the first to third internal spaces 23*a*, 23*b*, 23*c*, respectively, are described below.

(4-5-1) First Internal Space 23*a*

Figure 9:
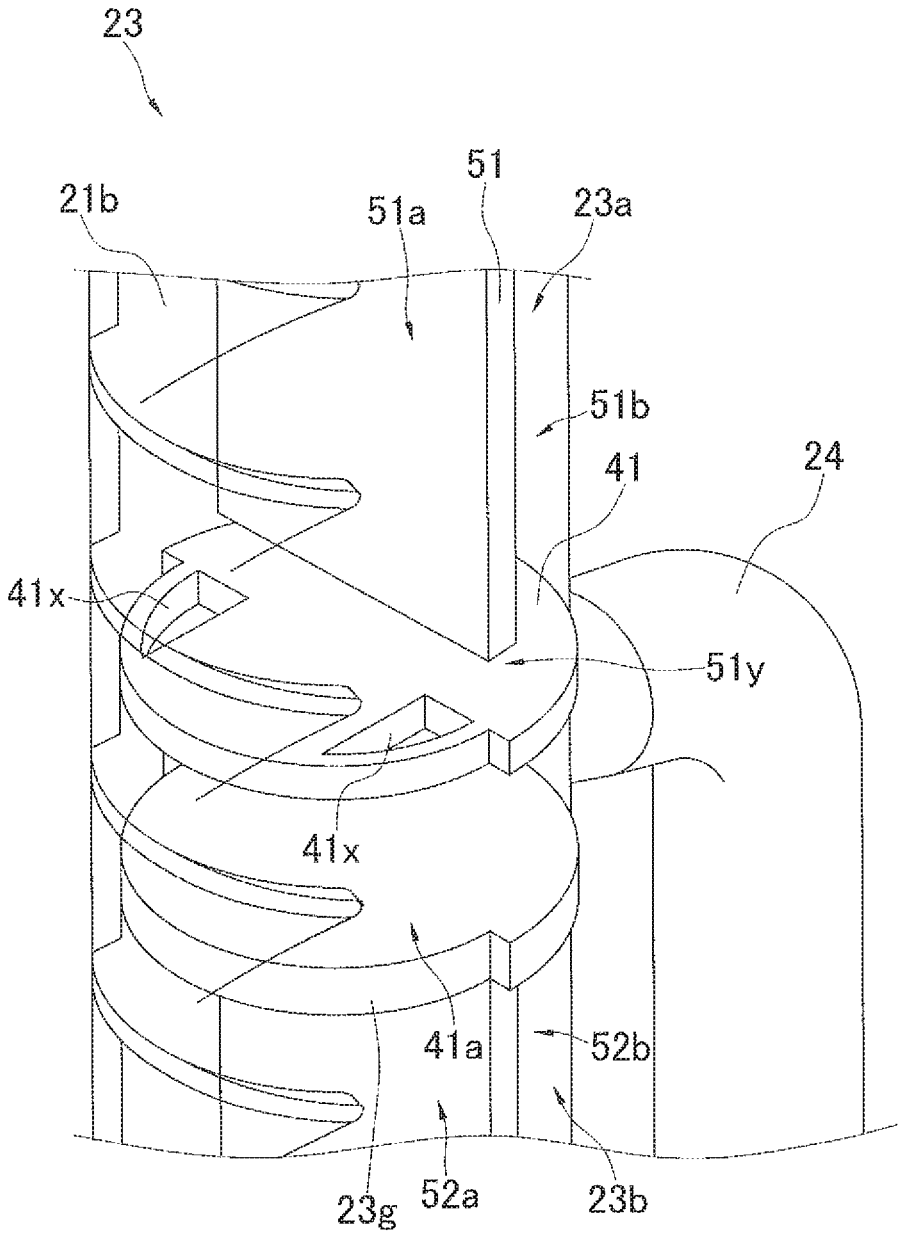
FIG. 9 is a simplified configuration perspective view of a section near the upper part of a doubled-back header collecting tube.
Figure 10:
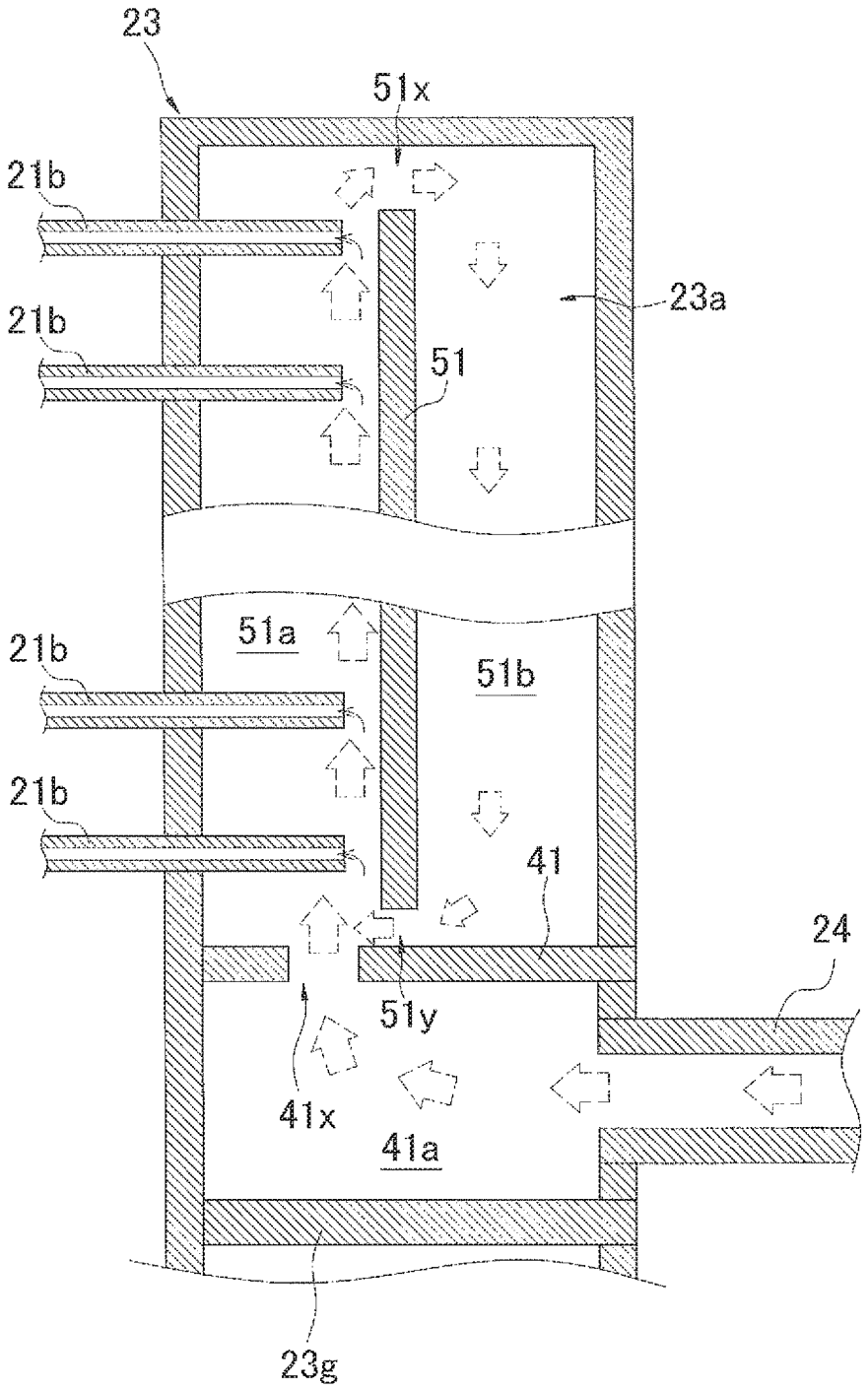
FIG. 10 is a simplified cross sectional view of the vicinity of a first internal space of a doubled-back header collecting tube.
Figure 11:
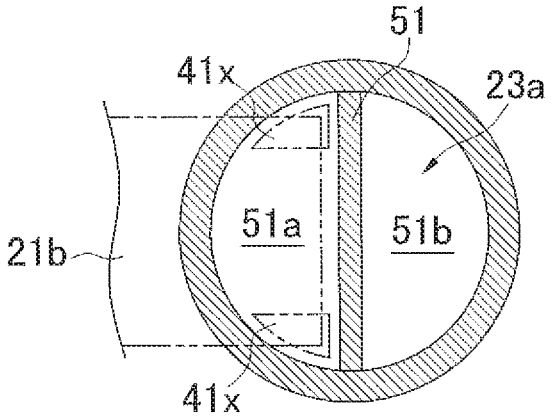
FIG. 11 is a simplified top view of the vicinity of a first internal space of a doubled-back header collecting tube.

The highest first internal space 23*a* of the doubled-back header collecting tube 23 is provided with a first flow regulation plate 41 and a first partition plate 51, as shown in FIG. 6, the simplified perspective view of FIG. 9, the simplified cross-sectional view of FIG. 10, and the simplified top view of FIG. 11.

The first flow regulation plate 41 is a substantially disk-shaped plate member that partitions the first internal space 23*a* into a first flow regulation space 41*a* below, and a first outflow space 51*a* and first loop structure 51*b* above. The first flow regulation space 41*a* is a space located above the second baffle 23*g* partitioning the first internal space 23*a* and the second internal space 23*b*, and below the first flow regulation plate 41 disposed at a location lower than the flat multi-perforated tube 21*b* immediately above the second baffle 23*g*. The interconnecting pipeline 24 extending out from the bottommost sixth space 23*f* of the doubled-back header collecting tube 23 communicates with this first flow regulation space 41*a*.

In this embodiment, the wall surface (peripheral surface) of the first flow regulation space 41*a* below the first flow regulation plate 41, on the side where the interconnecting pipeline 24 is connected, is positioned as an extension of the wall surface (peripheral surface) on the side of the first loop space 51*b*. Specifically, the wall surface (peripheral surface) of the first flow regulation space 41*a* below the first flow regulation plate 41 on the side where the interconnecting pipeline 24 is connected, and the wall surface (peripheral surface) on the side of the first loop space 51*b*, both configure the peripheral surface of the doubled-back header collecting tube 23.

The first partition plate 51 is a substantially square plate member that partitions a space above the first flow regulation plate 41*a* in the first internal space 23*a* into a first outflow space 51*a* and a first loop space 51*b*. While there are no particular limitations, the first partition plate 51 in the present embodiment is disposed at the center of the first internal space 23*a* to partition the space above the first flow regulation space 41*a* such that the first outflow space 51*a* and the first loop space 51*b* are equal in breadth in top view. The first partition plate 51 is fastened such that side surfaces thereof contact an inner peripheral surface of the doubled-back header collecting tube 23. The first outflow space 51*a* is a space situated on the side at which the flat multi-perforated tubes 21*b* connect at their first ends in the first internal space 23*a*. The first loop space 51*b* is a space situated on the opposite side of the first partition plate 51 from the first outflow space 51*a* in the first internal space 23*a*.

At the upper part of the first internal space 23*a* is disposed a first upper communicating passage 51*x* constituted by a vertical gap between the inside of the top end of the doubled-back header collecting tube 23, and a top end section of the first partition plate 51.

At the bottom of the first internal space 23*a* is disposed a first lower communicating passage 51*y* constituted by a vertical gap between the top surface of the first flow regulation plate 41 and a bottom end section of the first partition plate 51. In the present embodiment, the first lower communicating passage 51*y* extends in a horizontal direction from the first loop space 51*b* side towards the first outflow space 51*a* side. An outlet at the first outflow space 51*a* side of this first lower communicating passage 51*y* is located further below the location of the bottommost of the flat multi-perforated tubes 21*b* connected to the first outflow space 51*a*.

As shown in FIG. 9, the first flow regulation plate 41 is furnished with two first inflow ports 41*x*; these are openings which are disposed in the first outflow space 51*a* constituting the space at the side at which the flat multi-perforated tubes 21*b* extend in the first internal space 23*a*, and which provide communication in the vertical direction. The two inflow ports 41*x* are disposed away to the upstream side and the downstream side in the air flow direction, i.e., the direction of inflow of air with respect to the outdoor heat exchanger 20. The first inflow ports 41*x* are formed so as to be greater in width closer towards the first partition plate 51 side in the direction of air flow, and narrower in width closer towards the flat multi-perforated tube 21*b* side in the direction of air flow. The first inflow ports 41*x* have shapes conforming to the inner peripheral surface of the doubled-back header collecting tube 23.

In this embodiment, because the outlet of the interconnecting pipeline 24 on the first flow regulation space 41*a* side is provided so as to be positioned below the first loop space 51*b*, the refrigerant flowing through the interconnecting pipeline 24 must be guided to the underside of the first outflow space 51*a* in order for the refrigerant to pass upward through the first inflow ports 41*x* of the first flow regulation plate 41. In this embodiment, the first flow regulation space 41*a* is provided so as to link the position where the outlet of the interconnecting pipeline 24 on the first flow regulation space 41*a* side is connected and the position below the first inflow ports 41*x* of the first flow regulation plate 41. Therefore, even if the outlet of the interconnecting pipeline 24 on the first flow regulation space 41*a* side is not directly connected to the underside of the first inflow ports 41*x* of the first flow regulation plate 41, refrigerant can be guided to the underside of the first inflow ports 41*x* of the first flow regulation plate 41 and can be made to pass upward through the first inflow ports 41*x*.

The first internal space 23*a* has a flow regulation structure in which the refrigerant passage area (the area of a horizontal plane) in the first inflow ports 41*x* is sufficiently smaller than the refrigerant passage area of the first flow regulation space 41*a* (the area of the horizontal plane of the first flow regulation space 41*a*). By adopting this flow regulation structure, the refrigerant flow going from the first flow regulation space 41*a* towards the first outflow space 51*a* can be sufficiently throttled, and the refrigerant flow velocity upwards in the vertical direction increased.

By partitioning off the space above the first flow regulation plate 41 within the first internal space 23*a* by means of the first partition plate 51, the refrigerant passage area at the first outflow space 51*a* side (the passage area of the ascending refrigerant flow within the first outflow space 51*a*) can be made smaller than the total horizontal area of the first outflow space 51*a* and the first loop space 51*b*. In so doing, it is easy to maintain the ascension velocity of refrigerant inflowing to the first outflow space 51*a* via the first inflow ports 41*x*, making it easy for the refrigerant to reach the upper section of the first outflow space 51*a*, even at a low circulation rate.

As shown in the simplified top view of FIG. 11, the flat multi-perforated tubes 21*b* are embedded within the first outflow space 51*a*, in such a way as to fill in half or more of the horizontal area at heightwise locations in the first outflow space 51*a* where the flat multi-perforated tubes 21*b* are absent. The flat multi-perforated tubes 21*b* and the first inflow ports 41*x* of the first flow regulation plate 41 are arranged at partially overlapping locations in top view.

However, this arrangement is such that when "the horizontal area of sections of flat multi-perforated tubes 21*b* extending into the first outflow space 51*a*" is subtracted from "the horizontal area at heightwise locations within the first outflow space 51*a* where no flat multi-perforated tube 21*b* is present," the remaining area (the area of sections in which the refrigerant bypasses and ascends the flat multi-perforated tubes 21*b* in the first outflow space 51*a*) is greater than the refrigerant passage area of the first lower communicating passage 51*y*. In so doing, it is possible for refrigerant inflowing to the first outflow space 51*a* via the first inflow ports 41*x* to not be passed towards the first loop space 51*b* side through the first lower communicating passage 51*y*, which is narrower and difficult to pass through, but to instead be guided so as to ascend through sections excluding the flat multi-perforated tubes 21*b* in the first outflow space 51*a*, which are wider and easier to pass through.

The first internal space 23*a* has a loop structure that includes the first inflow ports 41*x*, the first partition plate 51, the first upper communicating passage 51*x*, and the first lower communicating passage 51*y*. For this reason, as shown by arrows in FIG. 10, refrigerant that reaches the top in the first outflow space 51*a* without inflowing to the flat multi-perforated tubes 21*b* is guided into the first loop space 51*b* via the first upper communicating passage 51*x* above the first partition plate 51, descends by gravity in the first loop space 51*b*, and returns to the bottom of the first outflow space 51*a* via the first lower communicating passage 51*y* below the first partition plate 51. In so doing, it is possible for the refrigerant reaching the upper part of the first outflow space 51*a* to be looped around within the first internal space 23*a*.

(4-5-2) Second Internal Space 23*b*

Figure 12:
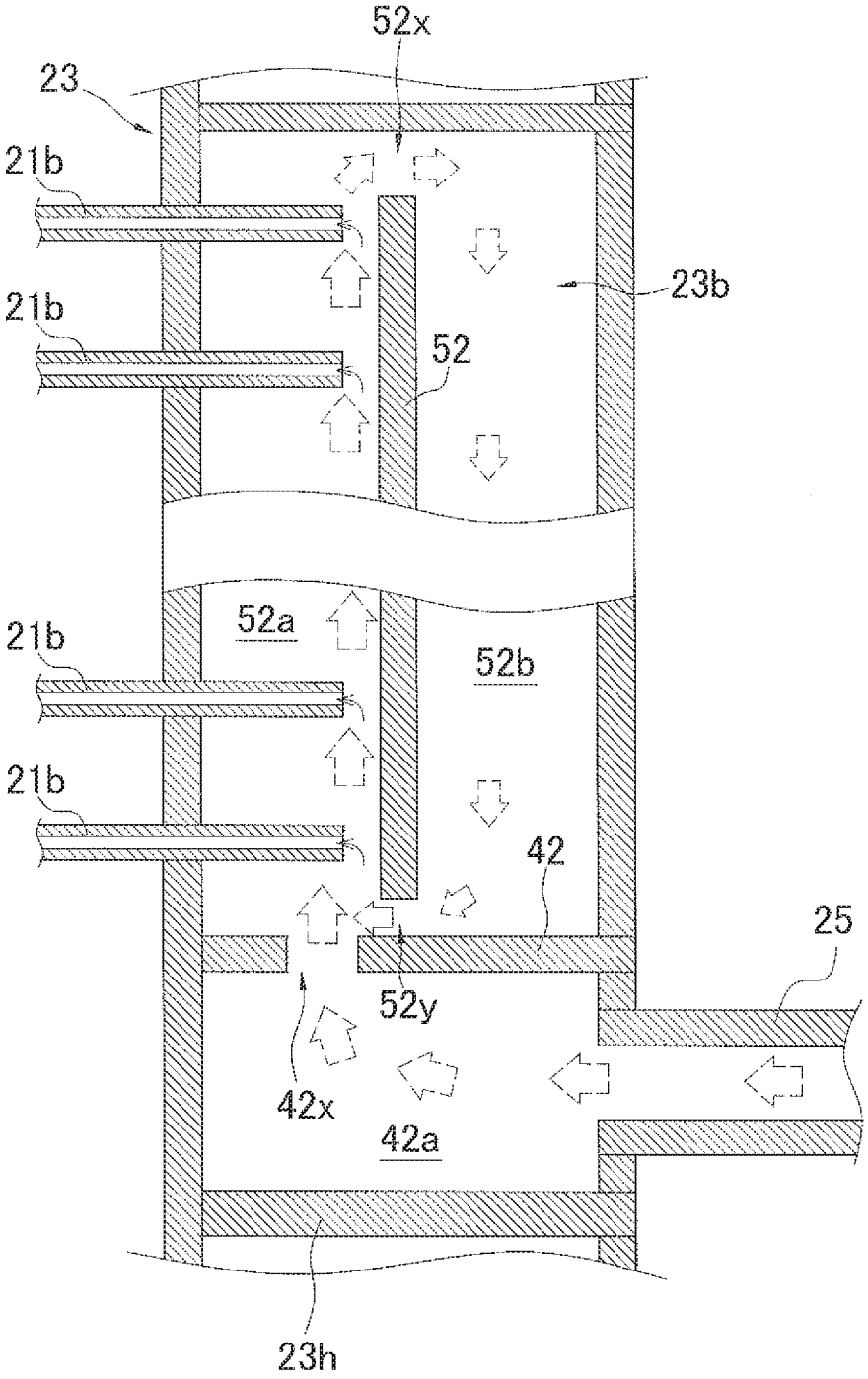
FIG. 12 is a simplified cross sectional view of the vicinity of a second internal space of a doubled-back header collecting tube.

The second internal space 23*b*, which is second from the upper part of the doubled-back header collecting tube 23, is similar in configuration to the topmost first internal space 23*a*, and as shown in FIG. 6, and in simplified cross sectional view in FIG. 12, respectively, is furnished with a second flow regulation plate 42 and a second partition plate 52.

The second flow regulation plate 42 is a substantially disk-shaped plate member that partitions the second internal space 23*b* into a second flow regulation space 42*a* below, and a second outflow space 52*a* and second loop space 52*b* above. The second flow regulation space 42*a* is a space located above the third baffle 23*h* partitioning the second internal space 23*b* and the third internal space 23*c*, and below the second flow regulation plate 42 disposed at a location lower than the flat multi-perforated tube 21*b* immediately above the third baffle 23*h*. The interconnecting pipeline 25 extending out from the fifth space 23*e* second from the bottom in the doubled-back header collecting tube 23 communicates with this second flow regulation space 42*a*.

In this embodiment, the wall surface (peripheral surface) of the second flow regulation space 42*a* below the second flow regulation plate 42, on the side where the interconnecting pipeline 25 is connected, is positioned as an extension of the wall surface (peripheral surface) on the side of the second loop space 52*b*. Specifically, the wall surface (peripheral surface) of the second flow regulation space 42*a* below the second flow regulation plate 42 on the side where the interconnecting pipeline 25 is connected, and the wall surface (peripheral surface) on the side of the second loop space 52*b*, both configure the peripheral surface of the doubled-back header collecting tube 23.

The second partition plate 52 is a substantially square plate member that partitions a space above the second flow regulation plate 42*a* in the second internal space 23*b* into a second outflow space 52*a* and a second loop space 52*b*. The second outflow space 52*a* is a space situated on the side at which the flat multi-perforated tubes 21*b* connect at their first ends, in the second internal space 23*b*. The second loop space 52*b* is a space situated on the opposite side of the second partition plate 52 from the second outflow space 52*a* in the second internal space 23*b*.

At the upper part of the second internal space 23*b* is disposed a second upper communicating passage 52*x* constituted by a vertical gap between the bottom surface of the second baffle 23*g* and a top end section of the second partition plate 52.

At the bottom of the first internal space 23*b* is disposed a second lower communicating passage 52*y* constituted by a vertical gap between the top surface of the second flow regulation plate 42 and a bottom end section of the second partition plate 52. In the present embodiment, the second lower communicating passage 52*y* extends in a horizontal direction from the second loop space 52*b* side towards the second outflow space 52*a* side. An outlet at the second outflow space 52*a* side of this second lower communicating passage 52*y* is located further below the location of the bottommost of the flat multi-perforated tubes 21*b* connected to the second outflow space 52*a*.

Like the first flow regulation plate 41, the second flow regulation plate 42 is furnished with two second inflow ports 42*x*, which are vertically communicating openings disposed at the side from which the flat multi-perforated tubes 21*b* extend in the second internal space 23*b*.

In this embodiment, because the outlet of the interconnecting pipeline 25 on the second flow regulation space 42*a* side is provided so as to be positioned below the second loop space 52*b*, the refrigerant flowing through the interconnecting pipeline 25 must be guided to the underside of the second outflow space 52*a* in order for the refrigerant to pass upward through the second inflow ports 42*x* of the second flow regulation plate 42. In this embodiment, the second flow regulation space 42*a* is provided so as to link the position where the outlet of the interconnecting pipeline 25 on the second flow regulation space 42*a* side is connected and the position below the second inflow ports 42*x* of the second flow regulation plate 42. Therefore, even if the outlet of the interconnecting pipeline 25 on the second flow regulation space 42*a* side is not directly connected to the underside of the second inflow ports 42*x* of the second flow regulation plate 42, refrigerant can be guided to the underside of the second inflow ports 42*x* of the second flow regulation plate 42 and can be made to pass upward through the second inflow ports 42*x*.

Like the first internal space 23*a*, the second internal space 23*b* has a flow regulation structure in which the refrigerant passage area (the area of a horizontal plane) in the second inflow ports 42*x* is sufficiently smaller than the refrigerant passage area of the second flow regulation space 42*a* (the area of the horizontal plane of the second flow regulation space 42*a*).

Further, like the first internal space 23*a*, the second internal space 23*b* has a loop structure that includes the second inflow ports 42*x*, the second partition plate 52, the second upper communicating passage 52*x*, and the second lower communicating passage 52*y*.

The details of the configuration of arrangement are otherwise the same as with the first internal space 23*a*, and accordingly are omitted here.

(4-5-3) Third Internal Space 23*c*

Figure 13:
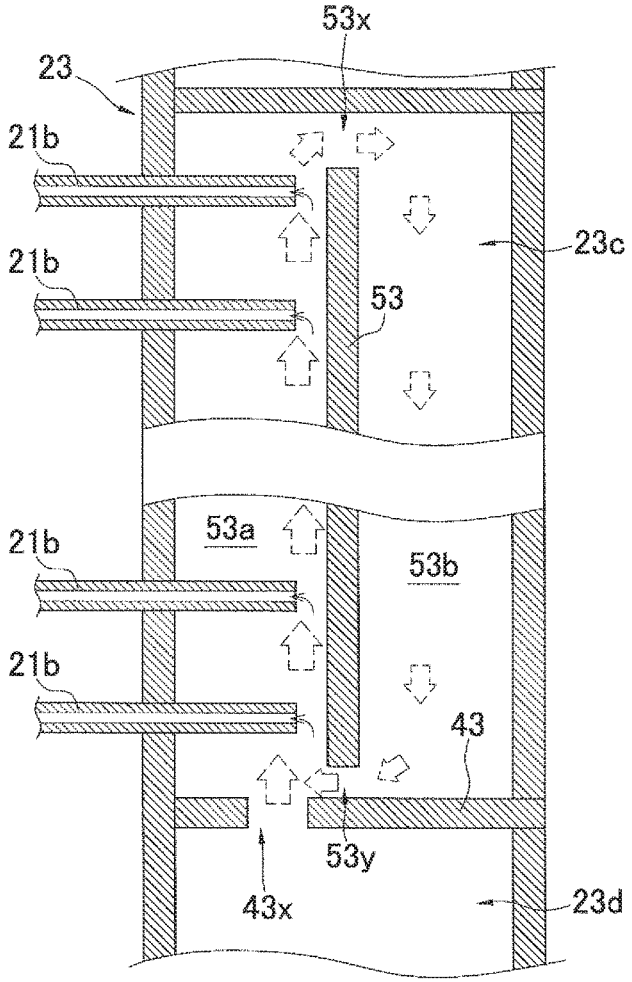
FIG. 13 is a simplified cross sectional view of the vicinity of a third internal space of a doubled-back header collecting tube.

The third internal space 23*c*, which is third from the upper part of the doubled-back header collecting tube 23, is furnished with a third flow regulation plate 43 and a third partition plate 53, as shown in FIG. 6, and in simplified cross sectional view in FIG. 13, respectively.

The third flow regulation plate 43 is a substantially disk-shaped plate member that partitions the third internal space 23*c* into a fourth internal space 23*d* (space located below) that is third from the bottom of the doubled-back header collecting tube 23, and a third outflow space 53*a* and a third loop space 53*b* which are located above.

The third partition plate 53 is a substantially square plate member that partitions a space above the fourth internal space 23*d* in the third internal space 23*c* into a third outflow space 53*a* and a third loop space 53*b*. The third outflow space 53*a* is a space situated on the side at which the flat multi-perforated tubes 21*b* connect at their first ends in the third internal space 23*c*. The third loop space 53*b* is a space situated on the opposite side of the third partition plate 53 from the third outflow space 53*a* in the third internal space 23*c*.

At the upper part of the third internal space 23*c* is disposed a third upper communicating passage 53*x* constituted by a vertical gap between the bottom surface of the third baffle plate 23*h* and a top end section of the third partition plate 53.

At the bottom of the third internal space 23*c* is disposed a third lower communicating passage 53*y* constituted by a vertical gap between the top surface of the third flow regulation plate 43 and a bottom end section of the third partition plate 53. In the present embodiment, the third lower communicating passage 53*y* extends in a horizontal direction from the third loop space 53*b* side towards the third outflow space 53*a* side. An outlet at the third outflow space 53*a* side of this third lower communicating passage 53*y* is located further below the location of the bottommost of the flat multi-perforated tubes 21*b* connected to the third outflow space 53*a*.

Like the first flow regulation plate 41 and the second first flow regulation plate 42, the third flow regulation plate 43 is furnished with two third inflow ports 43*x*, openings which are disposed at the side from which the flat multi-perforated tubes 21*b* extend in the third internal space 23*c*, and which provide communication in the vertical direction.

Like the first internal space 23*a* and the second internal space 23*b*, the third internal space 23*c* has a flow regulation structure in which the refrigerant passage area (the area of a horizontal plane) in the third inflow ports 43*x* is sufficiently smaller than the refrigerant passage area of the fourth internal space 23*d* (the area of the horizontal plane of the fourth internal space 23*d*).

Further, like the first internal space 23*a* and the second internal space 23*b*, the third internal space 23*c* has a loop structure that includes the third inflow ports 43*x*, the third partition plate 53, the third upper communicating passage 53*x*, and the third lower communicating passage 53*y*.

Other than the first flow regulation space 41*a* and the second flow regulation space 42*a*, the details of the configurations of arrangement are the same as with the first internal space 23*a* and the second internal space 23*b*, and accordingly are omitted here.

(5) Overview of Flow of Refrigerant in Outdoor Heat Exchanger 20 During Heating Mode The flow of refrigerant in the outdoor heat exchanger 20 constituted as shown above is described below, mainly in terms of the flow during heating mode.

As shown by an arrow in FIG. 5, during heating mode, refrigerant in a gas-liquid two-phase state is supplied to the lower outlet/inlet internal space 22*b* of the outlet/inlet header collecting tube 22 via the liquid refrigerant pipeline 32. In the description of the present embodiment, the state of the refrigerant inflowing to this lower outlet/inlet internal space 22*b* is assumed to be a gas-liquid two-phase state; however, depending on the outdoor temperature and/or the indoor temperature and/or the operational state, the inflowing refrigerant may be in a substantially single-phase liquid state.

The refrigerant supplied to the lower outlet/inlet internal space 22*b* in the bottom part of the outlet/inlet header collecting tube 22 passes through the plurality of flat multi-perforated tubes 21*b* in the bottom part of the heat exchange part 21 connected to the lower outlet/inlet internal space 22*b*, and is supplied respectively to the three fourth internal spaces 23*d*, 23*e*, 23*f* in the bottom part of the doubled-back header collecting tube 23. As the refrigerant supplied to the three fourth to sixth internal spaces 23*d*, 23*e*, 23*f* in the bottom part of the doubled-back header collecting tube 23 passes through the flat multi-perforated tubes 21*b* in the bottom part of the heat exchange part 21, a portion of the liquid phase component of the refrigerant in the gas-liquid two-phase state evaporates, thereby leading to a state in which the gas phase component is increased.

The refrigerant supplied to the sixth internal space 23*f* at the bottom of the doubled-back header collecting tube 23 passes through the interconnecting pipeline 24, and is supplied to the first flow regulation space 41*a* of the first internal space 23*a* in the top part of the doubled-back header collecting tube 23. The refrigerant supplied to the first flow regulation space 41*a* of the first internal space 23*a* flows through the inside of the first flow regulation space 41*a*, whereby the refrigerant is fed to the underside of the first inflow ports 41*x* of the first flow regulation plate 41. Having reached the underside of the first inflow ports 41*x* of the first flow regulation plate 41, the refrigerant passes upward through the first inflow ports 41*x* to be supplied to the first outflow space 51*a*. The refrigerant supplied to the first outflow space 51*a* goes on to flow into each of the plurality of flat multi-perforated tubes 21*b* (the manner in which refrigerant flows within the first internal space 23*a* is described hereinafter). The refrigerant flowing through the plurality of flat multi-perforated tubes 21*b* further evaporates into a gas phase state, and is supplied to the upper outlet/inlet internal space 22*a* at the upper part of the outlet/inlet header collecting tube 22.

The refrigerant supplied to the fifth internal space 23*e* in the bottom part of the doubled-back header collecting tube 23 passes through the interconnecting pipeline 25 to be supplied to the second flow regulation space 42*a* of the second internal space 23*b* in the top part of the doubled-back header collecting tube 23. The refrigerant supplied to the second flow regulation space 42*a* of the second internal space 23*b* flows through the inside of the second flow regulation space 42*a*, whereby the refrigerant is fed to the underside of the second inflow ports 42*x* of the second flow regulation plate 42. Having reached the underside of the second inflow ports 42*x* of the second flow regulation plate 42, the refrigerant passes upward through the second inflow ports 42*x* to be supplied to the second outflow space 52*a*. The refrigerant supplied to the second outflow space 52*a* goes on to flow into each of the plurality of flat multi-perforated tubes 21*b* (the manner in which refrigerant flows within the second internal space 23*b* is described hereinafter). The refrigerant flowing through the plurality of flat multi-perforated tubes 21*b* further evaporates into a gas phase state, and is supplied to the upper outlet/inlet internal space 22*a* at the upper part of the outlet/inlet header collecting tube 22.

The refrigerant supplied to the fourth internal space 23*d* in the bottom part of the doubled-back header collecting tube 23 passes upward on the vertical through the third inflow ports 43*x* furnished to the third flow regulation plate 43, and is supplied to the internal space of the third internal space 23*c* in the top part of the doubled-back header collecting tube 23. The refrigerant supplied to the third internal space 23*c* inflows respectively to the plurality of flat multi-perforated tubes 21*b* connected to the third internal space 23*c* (the flow of refrigerant within the third internal space 23*c* will be discussed below). The refrigerant flowing through the plurality of flat multi-perforated tubes 21*b* further evaporates into a gas phase state, and is supplied to the upper outlet/inlet internal space 22*a* at the upper part of the outlet/inlet header collecting tube 22.

The refrigerant which has flowed from the first to third internal spaces 23*a*, 23*b*, 23*c* in the top part of the doubled-back header collecting tube 23 through the flat multi-perforated tubes 21*b* and been supplied to the upper outlet/inlet internal space 22*a* at the upper part of the outlet/inlet header collecting tube 22 converges in the upper outlet/inlet internal space 22*a*, and flows out from the gas refrigerant pipeline 31.

In cooling mode, the refrigerant flow is the reverse of the flow indicated by arrows in FIG. 5.

(6) Flow of Refrigerant in Outdoor Heat Exchanger 20 in a Case of a Low Circulation Rate During Heating Mode The flow of refrigerant in the outdoor heat exchanger 20 in a case of a low circulation rate during heating mode will be described below, taking the example of the first internal space 23*a* of the doubled-back header collecting tube 23.

The refrigerant inflowing to the lower outlet/inlet internal space 22*b* of the outlet/inlet header collecting tube 22 is depressurized in the expansion valve 33, and thereby enters a gas-liquid two-phase state. A portion of the liquid phase component in the refrigerant in the gas-liquid two-phase state that has flowed into to the first internal space 23*a* of the doubled-back header collecting tube 23 evaporates in the course of passage through the flat multi-perforated tubes 21*b* from the lower outlet/inlet internal space 22*b* of the outlet/inlet header collecting tube 22 towards the sixth internal space 23*f* of the doubled-back header collecting tube 23. For this reason, the refrigerant passing through the interconnecting pipeline 24 and flowing into the first internal space 23*a* of the doubled-back header collecting tube 23 is a mixture of a gas phase component and a liquid phase component that differ in specific gravity.

Figure 14:
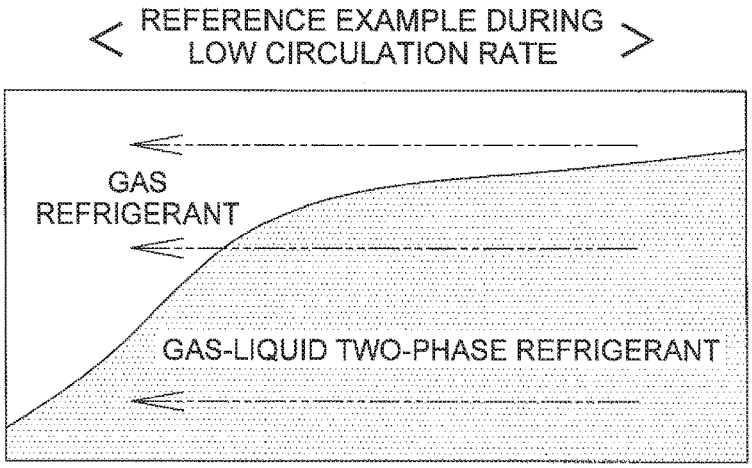
FIG. 14 is a descriptive diagram for reference purposes, showing a condition of refrigerant distribution at a low circulation rate.

In the case of a low circulation rate, the amount of refrigerant inflowing per unit time into the first flow regulation space 41*a* via the interconnecting pipeline 24 is small, and the flow velocity of the refrigerant flowing through the outlet of the interconnecting pipeline 24 is relatively slow. For this reason, as long as this flow velocity remains unchanged, the high-specific gravity liquid phase component in the refrigerant ascends with difficulty, and only with difficulty can reach the tubes at the top among the plurality of flat multi-perforated tubes 21*b* connected to the first internal space 23*a*, which can in some cases lead to uneven rates of passage through the plurality of flat multi-perforated tubes 21*b*, depending on their heightwise locations, and pose a risk of eccentric flow. Accordingly, as shown in the descriptive diagram of FIG. 14 which depicts a reference example during a low circulation rate, when the low-specific gravity gas phase component in the refrigerant flows mainly to the first end side of flat multi-perforated tubes 21*b* that are situated relatively towards the top, the degree of superheat of the refrigerant flowing out from the other end side of these flat multi-perforated tubes 21*b* becomes too great, phase change no longer occurs during passage through the flat multi-perforated tubes 21*b*, and heat exchange capability cannot be sufficiently achieved. Meanwhile, when the high-specific gravity liquid phase component in the refrigerant flows mainly into the first end side of the flat multi-perforated tubes 21*b* that are situated relatively towards the bottom, the refrigerant flowing out from the other end side of these flat multi-perforated tubes 21*b* does not easily reach superheat, and in some instances will reach the other end side of the flat multi-perforated tubes 21*b* without evaporating, so that ultimately heat exchange capability cannot be sufficiently achieved.

In contrast, with the outdoor heat exchanger 20 of the present embodiment, the refrigerant supplied to the first flow regulation space 41*a* experiences an increase in the flow velocity of the vertical upward refrigerant flow as it passes through the first inflow ports 41*x* of the first flow regulation plate 41, which have a throttling function. Moreover, because the space above the first flow regulation plate 41 in the first internal space 23*a* is furnished with the first partition plate 51, the refrigerant passage area of the space on the side where the first inflow ports 41*x* are disposed (the first outflow space 51*a*) is constituted so as to be narrower as compared to the case where the first partition plate 51 is absent, and therefore the ascending flow velocity does not readily decline. For this reason, even in cases of a low circulation rate, the high-specific gravity liquid phase component in the refrigerant can be easily guided to the top within the first outflow space 51*a*.

As the refrigerant inflowing to the first outflow space 51*a* via the first inflow ports 41*x* ascends within the first outflow space 51*a*, the flow is divided among the flat multi-perforated tubes 21*b*, but a small portion of the refrigerant is guided to the top end of the first outflow space 51*a* without flowing into the flat multi-perforated tubes 21*b*.

The refrigerant having reached the top end of the first outflow space 51*a* in this manner is guided into the first loop space 51*b* via the first upper communicating passage 51*x*, and through gravity descends in the first loop space 51*b*. The refrigerant having descended in the first loop space 51*b* flows in a horizontal direction while passing through the first lower communicating passage 51*y* which extends in the horizontal direction, and again returns to the bottom of the first outflow space 51*a*.

The refrigerant that has returned to the first outflow space 51*a* via the lower communicating passage 51*y* is entrained by the ascending flow of the refrigerant passing through the first inflow ports 41*x* and again ascends within the first outflow space 51*a*, and according to circumstances can be made to inflow to the flat multi-perforated tubes 21*b* after being recirculated through the first internal space 23*a*.

Figure 15:
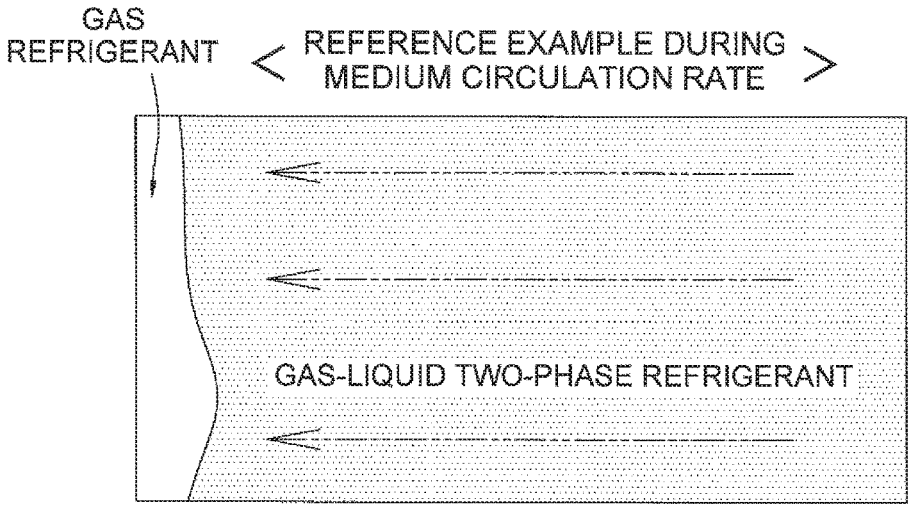
FIG. 15 is a descriptive diagram for reference purposes, showing a condition of refrigerant distribution at a medium circulation rate.

In so doing, in the outdoor heat exchanger 20 of the present embodiment, even at times of a low circulation rate, it is possible for the state of the refrigerant flowing into the plurality of flat multi-perforated tubes 21*b* arranged at sections of different heights to be brought into approximation with the state depicted in the descriptive diagram of FIG. 15, which shows a reference example during a medium circulation rate, and rendered as uniform as possible.

The second internal space 23*b* of the doubled-back header collecting tube 23 is similar to the first internal space 23*a*, and accordingly is not described here.

The third internal space 23*c* of the doubled-back header collecting tube 23, unlike the first internal space 23*a* or the second internal space 23*b*, is not provided with structures corresponding to the first flow regulation space 41*a* or the second flow regulation space 42*a*, and the effects of these structures are therefore not produced, but the features are otherwise the same and are accordingly not described here.

(7) Flow of Refrigerant in Outdoor Heat Exchanger 20 in a Case of a High Circulation Rate During Heating Mode The flow of refrigerant in the outdoor heat exchanger 20 in a case of a high circulation rate during heating mode will be described below, taking the example of the first internal space 23*a* of the doubled-back header collecting tube 23.

Here, just as in the case of a low circulation rate, the state of the refrigerant inflowing to the first internal space 23*a* of the doubled-back header collecting tube 23 is one of admixture of a gas phase component and a liquid phase component differing in specific gravity.

Figure 16:
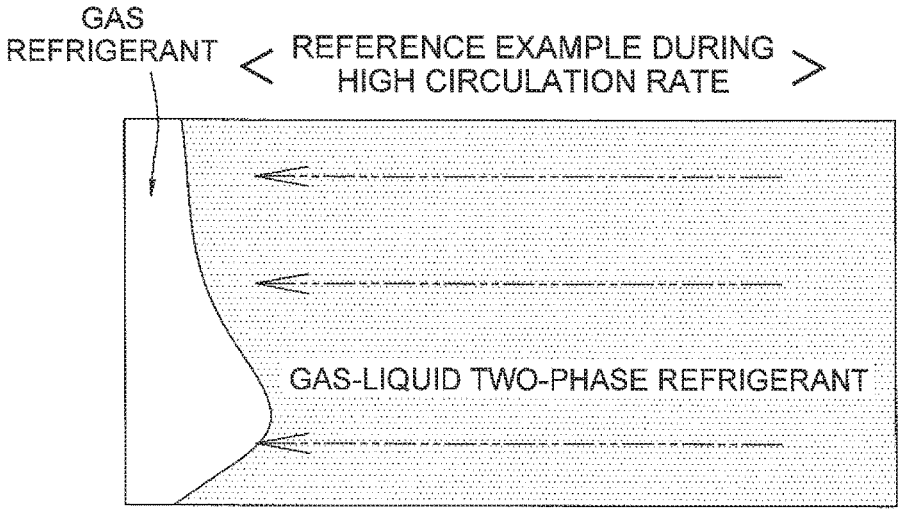
FIG. 16 is a descriptive diagram for reference purposes, showing a condition of refrigerant distribution at a high circulation rate.

In the case of a high circulation rate, the amount of refrigerant inflowing per unit time into the first flow regulation space 41*a* via the interconnecting pipeline 24 is large, and the flow velocity of the refrigerant flowing through the outlet of the interconnecting pipeline 24 is relatively fast. Moreover, the flow velocity is increased even further by the adoption of the throttling function of the first inflow ports 41*x* as the low circulation flow countermeasure discussed previously. Further, due to the narrow refrigerant passage area (cross-sectional area) of the first outflow space 51*a*, the refrigerant passage area of which is constricted by the first partition plate 51 as the low circulation flow countermeasure discussed previously, there is almost no letdown in the ascension velocity of the refrigerant. For this reason, in cases of a high circulation rate, the high-specific gravity liquid phase component of the refrigerant passing forcefully through the first inflow ports 41*x* tends to pass through the first outflow space 51*a* without inflowing to the flat multi-perforated tubes 21*b*, and tends to collect at the top. In such cases, the high-specific gravity liquid phase component tends to collect at the top while low-specific gravity gas phase component tends to collect at the bottom, and ultimately, eccentric flow arises as shown in the descriptive diagram of FIG. 16, showing a reference example during a high circulation rate, although the distribution differs from that at times of a low circulation rate.

In contrast to this, with the outdoor heat exchanger 20 of the present embodiment, due to the adoption of the loop structure in the first internal space 23*a*, the refrigerant reaching the top end of the first outflow space 51*a* is guided into the first loop space 51*b* via the first upper communicating passage 51*x*, and after descending in the first loop space 51*b* is again returned to the first outflow space 51*a* via the first lower communicating passage 51*y*, and thereby can be guided into the flat multi-perforated tubes 21*b* located towards the bottom of the first outflow space 51*a*.

The refrigerant that has returned to the first outflow space 51*a* via the lower communicating passage 51*y* is entrained by the ascending flow of the refrigerant passing through the first inflow ports 41*x* and again ascends within the first outflow space 51*a*, and according to circumstances can be made to inflow to the flat multi-perforated tubes 21*b* after being recirculated through the first internal space 23*a*.

In so doing, in the outdoor heat exchanger 20 of the present embodiment, even at times of a high circulation rate, it is possible for the state of the refrigerant flowing into the plurality of flat multi-perforated tubes 21*b* arranged at sections of different heights to be brought into approximation with the state depicted in the descriptive diagram of FIG. 15, showing a reference example during a medium circulation rate, and to be rendered as uniform as possible.

The second internal space 23*b* of the doubled-back header collecting tube 23 is similar to the first internal space 23*a*, and accordingly is not described here.

The third internal space 23*c* of the doubled-back header collecting tube 23, unlike the first internal space 23*a* or the second internal space 23*b*, is not provided with structures corresponding to the first flow regulation space 41*a* or the second flow regulation space 42*a*, and the effects of these structures are therefore not produced, but the features are otherwise the same and are accordingly not described here.

(8) Characteristics of Outdoor Heat Exchanger 20 of Air Conditioning Device 1

(8-1)

With the outdoor heat exchanger 20 of the present embodiment, even in cases of a low circulation rate, the ascent velocity of the refrigerant in the first inner space 23*a* of the doubled-back header collecting tube 23 is maintained by the configurations of the first inflow ports 41*x* and the first outflow space 51*a* constricted by the first partition plate 51, so that the refrigerant can more easily reach the upper part of the first outflow space 51*a* (the design of the second internal space 23*b* and the third internal space 23*c* is the same).

Additionally, with the outdoor heat exchanger 20 of the present embodiment, even in cases of a high circulation rate, the refrigerant loops around within the first internal space 23*a* due to the loop structure adopted in the first internal space 23*a* of the doubled-back header collecting tube 23, whereby the refrigerant can be guided into the flat multi-perforated tubes 21*b*.

In the above manner, with the outdoor heat exchanger 20 of the present embodiment, both in cases of a low circulation rate and cases of a high circulation rate, eccentric flow of refrigerant to the plurality of flat multi-perforated tubes 21*b* arranged side by side in the vertical direction can be kept to a minimum.

(8-2)

In the outdoor heat exchanger 20 of the present embodiment, the loop structure and the flow regulating structure are adopted not in the upper outlet/inlet internal space 22*a* and the lower outlet/inlet internal space 22*b* of the outlet/inlet header collecting tube 22, and not in the fourth through sixth internal spaces 23*d*, 23*e*, 23*f* of the doubled-back header collecting tube 23, but in the first through third internal spaces 23*a*, 23*b*, 23*c* of the doubled-back header collecting tube 23. Specifically, the loop structure and the flow regulating structure are adopted in the first to third internal spaces 23*a*, 23*b*, 23*c* of the doubled-back header collecting tube 23, in which the refrigerant flowing therethrough in heating mode contains large amounts of admixed gas phase and liquid phase components, resulting in a marked tendency for eccentric flow to arise among the flat multi-perforated tubes 21*b* at different heights.

Therefore, it is possible for the effect of suppressing eccentric flow to be sufficiently realized.

(8-3)

The refrigerant which has passed through the first inflow ports 41*x* of the outdoor heat exchanger 20 of the present embodiment and just flowed into the first outflow space 51*a* is at maximum ascent velocity, and in some instances tends not to pass through the lower tubes among the plurality of flat multi-perforated tubes 21*b* connected to the first outflow space 51*a*.

In contrast, with the outdoor heat exchanger 20 of the present embodiment, the outlet at the first outflow space 51*a* side of the first lower communicating passage 51*y* is arranged such the refrigerant descending in the first loop space 51*b* in the first internal space 23*a* of the doubled-back header collecting tube 23 can be guided into the flat multi-perforated tubes 21*b* that are connected to the bottom of the first outflow space 51*a*.

For this reason, the flat multi-perforated tubes 21*b* that are located at the bottom, through which the high-flow velocity refrigerant inflowing to the first outflow space 51*a* via the first inflow ports 41*x* tends not to pass, can be easily supplied with the refrigerant that has been returned to the first outflow space 51*a* via the first lower communicating passage 51*y*.

The above feature is the same for the second through the third internal spaces 23*b*, 23*c* as well.

(8-4)

The outdoor heat exchanger 20 of the present embodiment has a structure in which the distal end of the interconnecting pipeline 24 is connected to the first internal space 23*a* on the opposite side of which the flat multi-perforated tubes 21*b* are connected in the doubled-back header collecting tube 23. In the first internal space 23*a*, an ascending flow of refrigerant is created in the first outflow space 51*a*, which is the space on the side where the flat multi-perforated tubes 21*b* are connected in the doubled-back header collecting tube 23. Therefore, the doubled-back header collecting tube 23 has a structure in which the side where refrigerant is supplied to the first internal space 23*a* and the side where an ascending flow of refrigerant is created in the first internal space 23*a* are positioned on opposite sides.

In the outdoor heat exchanger 20 in this embodiment, the refrigerant supplied to the first internal space 23*a* is made to pass through the inside of the first flow regulation space 41*a*, whereby an ascending flow of refrigerant is created in the first internal space 23*a* and the refrigerant can be guided to the underside of the first inflow ports 41*x* of the first flow regulation plate 41. The refrigerant guided to the underside of the first inflow ports 41*x* of the first flow regulation plate 41 can thereby be made to pass upward through the first inflow ports 41*x*, and an ascending flow of refrigerant can be created in the first outflow space 51*a*, which is the space on the side where the flat multi-perforated tubes 21*b* are connected in the doubled-back header collecting tube 23.

The above feature is the same for the second internal spaces 23*b* as well.

(9) Additional Embodiments

The preceding embodiment has been described as but one example of embodiment of the present invention, but is in no way intended to limit the invention of the present application, which is not limited to the aforedescribed embodiment. The scope of the invention of the present application would as a matter of course include appropriate modifications that do not depart from the spirit thereof.

(9-1) Additional Embodiment A

In the aforedescribed embodiment, an example was described of a case in which the flat multi-perforated tubes 21*b* were not connected to the first flow regulation space 41*a* (or to the second flow regulation space 42*a*).

Figure 17:
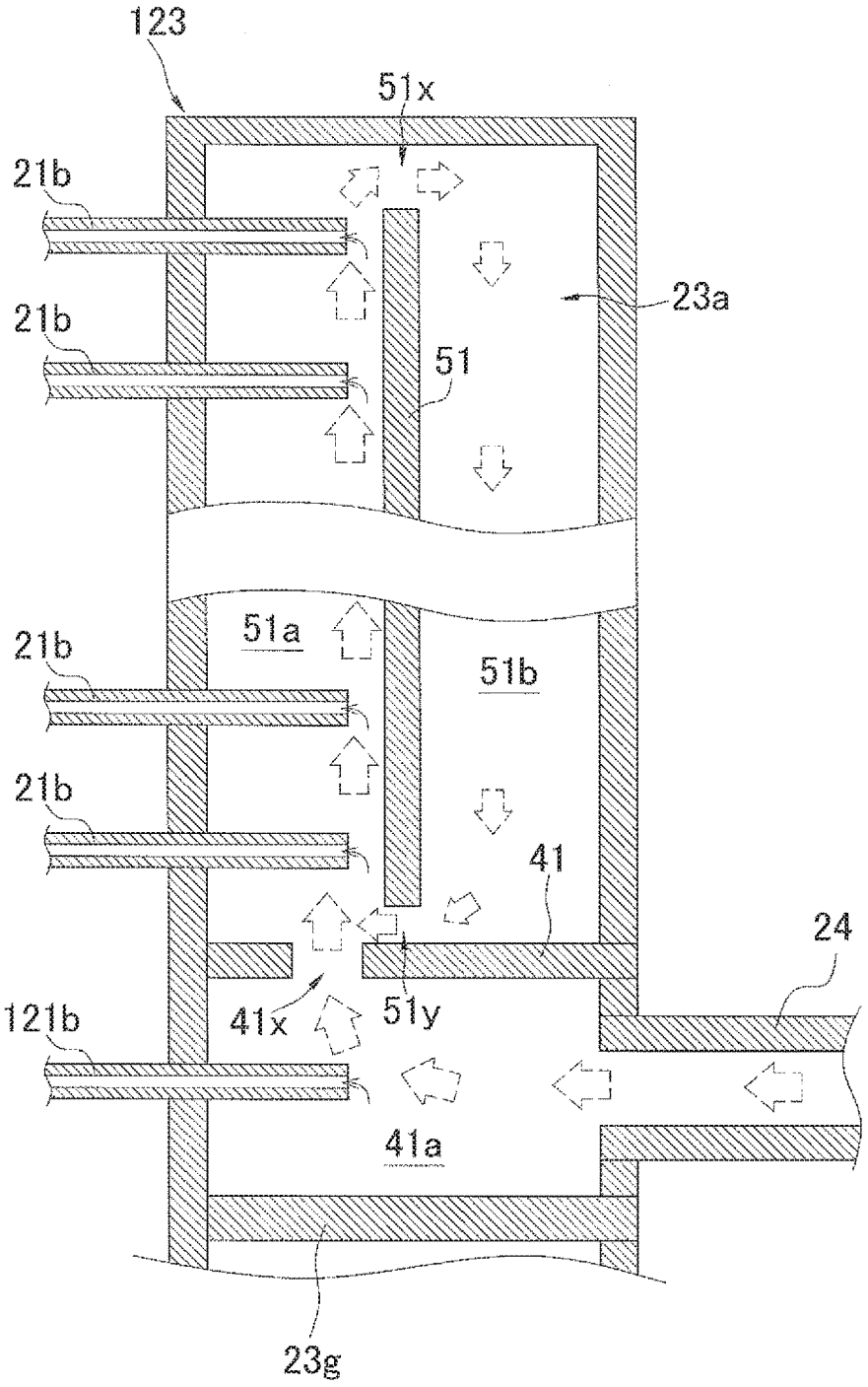
FIG. 17 is a simplified cross-sectional view of the vicinity of a first internal space of a doubled-back header collecting tube according to another Embodiment A.

However, the present invention is not limited to this arrangement; a flat multi-perforated tube 121*b*, similar to the flat multi-perforated tubes 21*b* connected to the first outflow space 51*a*, may be connected in the first flow regulation space 41*a* as well, as is the case in, e.g., the header collecting tube 123 shown in FIG. 17. This flat multi-perforated tube 121*b* may be similarly arranged side by side in the vertical direction with the plurality of flat multi-perforated tubes 21*b* connected to the first outflow space 51*a*.

Thus, in a structure in which the flat multi-perforated tube 121*b* is connected in the first flow regulation space 41*a* on the side where the first inflow ports 41*x* are provided in the first flow regulation plate 41, connecting the interconnecting pipeline 24 on the same side as that to which the flat multi-perforated tube 121*b* is connected would be difficult in terms of ensuring a connecting location. Specifically, there would be cases in which it would be difficult even to directly guide the refrigerant passing through the interconnecting pipeline 24 to the space in the first flow regulation space 41*a* that is underneath the first inflow ports 41*x* of the first flow regulation plate 41.

Even in such cases, refrigerant fed in via the interconnecting pipeline 24 could be guided to the underside of the first inflow ports 41*x* of the first flow regulation plate 41, due to the first flow regulation space 41*a* linking the outlet section of the interconnecting pipeline 24 and the space underneath the first inflow ports 41*x* of the first flow regulation plate 41, as is the case in the header collecting tube 123 shown in FIG. 17. An ascending flow of refrigerant can be created in the first outflow space 51*a* by allowing the refrigerant to pass upward through the first inflow ports 41*x* of the first flow regulation plate 41.

The above feature is the same for the second flow regulation space 42*a*.

(9-2) Additional Embodiment B

In the aforedescribed embodiment, an example was described of a case in which the side of the doubled-back header collecting tube 23 where the flat multi-perforated tubes 21*b* were connected and the side where the interconnecting pipeline 24 was connected faced each other (were on opposite sides) (the same with the interconnecting pipeline 25)).

Figure 18:
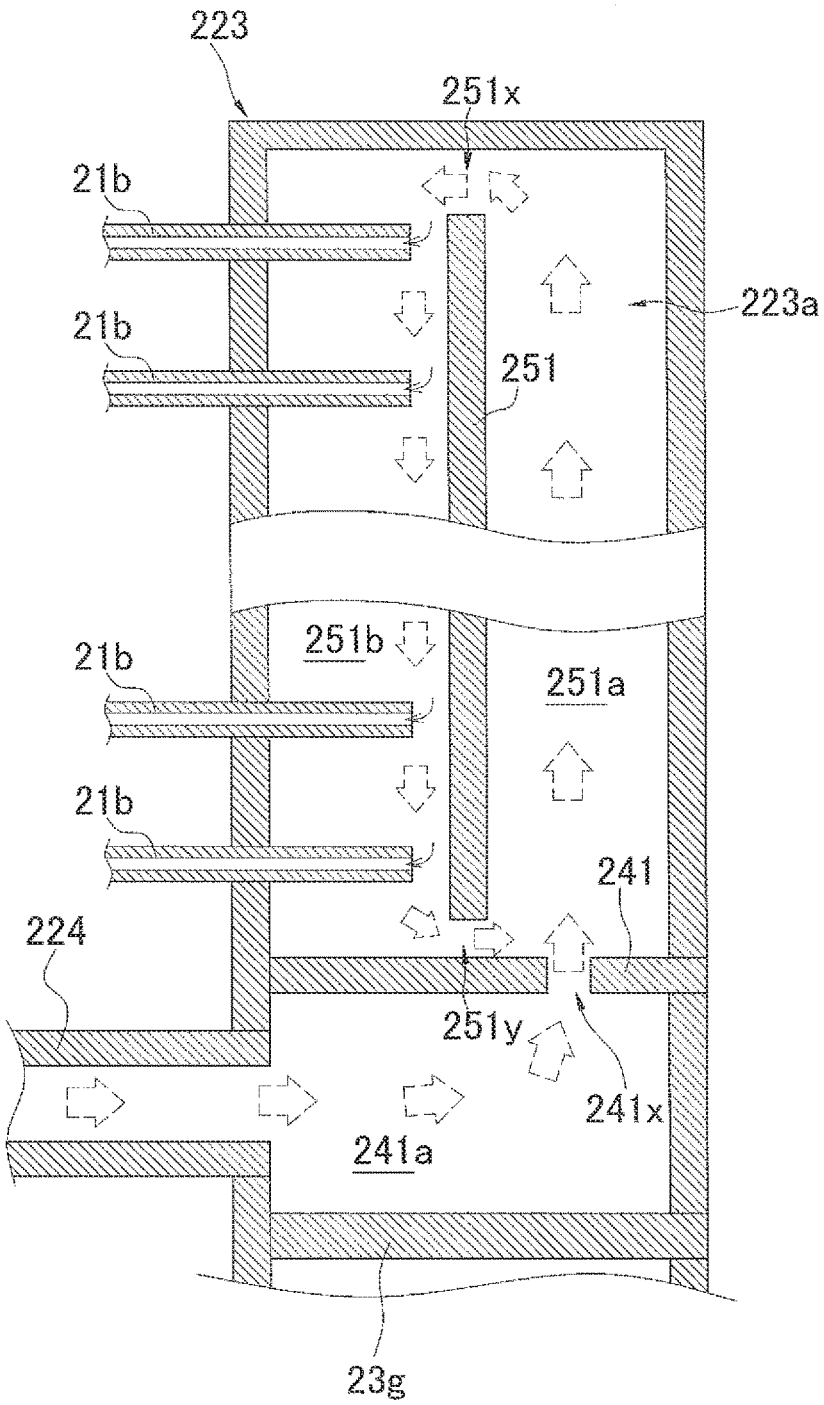
FIG. 18 is a simplified cross-sectional view of the vicinity of a first internal space of a doubled-back header collecting tube according to another Embodiment B.

However, the present invention is not limited to this arrangement, and the flat multi-perforated tubes 21*b* and an interconnecting pipeline 224 may be connected in the same direction, as is the case in, e.g., a doubled-back header collecting tube 223 shown in FIG. 18. In this embodiment, a first internal space 223*a* of the doubled-back header collecting tube 223 is partitioned by a first flow regulation plate 241 into a first outflow space 251*b* and first loop space 251*a* above, and a first flow regulation space 241*a* below. A first partition plate 251 partitions the first internal space 223*a* into the first loop space 251*a* where an ascending flow of refrigerant is created, and the first outflow space 251*b* to which the flat multi-perforated tubes 21*b* are connected and where a descending flow of refrigerant is created. A first upper communicating passage 251*x* directs refrigerant ascending through the first loop space 251*a* from the first loop space 251*a* to the first outflow space 251*b*, above the first partition plate 251. A first lower communicating passage 251*y* returns refrigerant descending without being sucked into the flat multi-perforated tubes 21*b* from the first outflow space 251*b* to the first loop space 251*a*, below the first partition plate 251. First inflow ports 241*x* are formed vertically through the first flow regulation plate 241*x* on the opposite side of which the flat multi-perforated tubes 21*b* and the interconnecting pipeline 224 are connected.

Thus, even with a structure in which refrigerant cannot be supplied directly to the underside of the first inflow ports 241*x* in the first flow regulation plate 241 due to the interconnecting pipeline 224 being connected to the side opposite from the first inflow ports 241*x*, in the first flow regulation plate 241 that is the refrigerant can be guided to the underside of the first inflow ports 241*x* due to the first flow regulation space 241*a* being provided. An ascending flow of refrigerant can thereby be created in the first loop space 251*a*, due to the refrigerant being made to pass upward through first inflow ports 241*x*.

In the first internal space 223*a*, refrigerant reaches the top easily because the first loop space 251*a* is narrowed due to the first partition plate 251 being provided. In this embodiment, the refrigerant that has reached the upper part of the first loop space 251*a* is fed to the first outflow space 251*b* via the first upper communicating passage 251*x*, and the refrigerant goes on to flow to the flat multi-perforated tubes 21*b* while descending in the first outflow space 251*b*. The refrigerant that has descended without being sucked into the flat multi-perforated tubes 21*b* is fed back into the first loop space 251*a* via the first lower communicating passage 251*y*. In this manner does the refrigerant circulate.

(9-3) Additional Embodiment C

In the aforedescribed embodiment, there was described an example of a case in which the first flow regulation plate 41, a plate-shaped member, is furnished with the first inflow ports 41*x* that open in the thickness direction (as do the second inflow ports 42*x* and the third inflow ports 43*x*).

However, the present invention is not limited to this arrangement, and, for example, a cylindrical inflow passage extending in the vertical direction could be furnished in place of inflow ports formed by openings in a plate-shaped member. In this case, it will be possible to further boost the velocity of the refrigerant outflowing vertically upward as the refrigerant passes through the cylindrical inflow passage.

The above feature could be implemented analogously in the second inflow ports 42*x* and the third inflow ports 43*x* as well.

(9-4) Additional Embodiment D

In the aforedescribed embodiment and additional embodiments, there were described examples of cases in which the space above the first flow regulation plate 41 of the first internal space 23*a*, the space above the second flow regulation plate 42 of the second internal space 23*b*, and the space above the third flow regulation plate 43 in the third internal space 23*c* are similar in form.

However, the present invention is not limited to this arrangement; it would be acceptable for the forms to differ from one another.

(9-5) Additional Embodiment E

In the aforedescribed embodiment, there was described an example of a case in which flat plate members like the heat transfer fins 21*a* shown in FIGS. 7 and 8 are employed as heat transfer fins.

However, the present invention is not limited to this arrangement, and application, for example, to a heat exchanger employing corrugated type heat transfer fins, such as those employed primarily in automotive heat exchangers, would also be possible.

What is claimed is:

1. A heat exchanger, comprising:

a plurality of flat tubes arranged mutually side by side, each of the flat tubes having a plurality of refrigerant passages extending in a longitudinal direction;

a header collecting tube extending in a vertical direction; and a plurality of fins joined to the flat tubes, the header collecting tube having a loop structure including a first partition member partitioning an internal space into an upper internal portion and a lower internal portion vertically below the upper internal portion, a second partition member partitioning the upper internal portion into a first space useable to make refrigerant ascend, and a second space useable to make refrigerant descend, when the heat exchanger functions as an evaporator of refrigerant, a first lateral side inflow port formed on the first partition member at a bottom part of the first space so as to penetrate in a plate thickness direction, an upper communicating passage located at upper parts of the first space and the second space, the upper communicating passage providing communication between the upper part of the first space and the upper part of the second space, thereby guiding the refrigerant that has ascended within the first space into the second space, and a lower communicating passage located at lower parts of the first space and the second space, the lower communicating passage providing communication between the lower part of the first space and the lower part of the second space and guiding the refrigerant from the second space to the first space, thereby returning the refrigerant from the second space to the first space, which has been guided from the first space to the second space and has descended within the second space, the first partitioning member being a substantially horizontally extending plate, a lower surface of the plate facing the lower internal portion, and an upper surface of the plate facing the first space and the second space, a lateral direction extending perpendicular to the vertical direction with the flat tubes being connected at one end to the first space of the header collecting tube on a first lateral side of the header collecting tube, a second lateral side inflow pipeline being connected to a space that, within the lower internal portion, is underneath the second space, the lower internal portion connecting the first lateral side inflow port and the second lateral side inflow pipeline, the lower internal portion having a first internal portion vertically below the first space and a second internal portion vertically below the second space, the second lateral side inflow pipeline being connected to the lower internal portion on a second lateral side of the header collecting tube, with the first and second lateral sides of the header collecting tube being on opposite lateral sides of the second partition member along the longitudinal direction, and opposite lateral sides of the second partition member being on opposite lateral sides of a vertical plane passing through the upper internal portion, the first partition member, the second partition member and the lower internal portion.

2. The heat exchanger according to claim 1, wherein in the header collecting tube, a wall surface of the lower internal portion on a side where the second lateral side inflow pipeline is connected is disposed as an extension of a wall surface of the upper internal portion on a side of the second space.

3. An air conditioning device including a refrigerant circuit formed by connecting the heat exchanger according to claim 1 and a variable-capacity compressor.

4. An air conditioning device including a refrigerant circuit formed by connecting the heat exchanger according to claim 2 and a variable-capacity compressor.

* * * * *